US006203964B1

(12) United States Patent
Obayashi et al.

(10) Patent No.: US 6,203,964 B1
(45) Date of Patent: Mar. 20, 2001

(54) IMAGE RECORDING MEDIUM AND IMAGE RECORDING METHOD

(75) Inventors: Tatsuhiko Obayashi; Junichi Yamanouchi; Atsuhiro Ohkawa, all of Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/524,537

(22) Filed: Mar. 13, 2000

Related U.S. Application Data

(62) Division of application No. 09/120,175, filed on Jul. 22, 1998, now Pat. No. 6,063,539.

(30) Foreign Application Priority Data

| | | |
|---|---|---|
| Jul. 22, 1997 | (JP) | 9-195897 |
| May 29, 1998 | (JP) | 10-149816 |
| May 29, 1998 | (JP) | 10-149817 |
| May 29, 1998 | (JP) | 10-149818 |

(51) Int. Cl.[7] ..... G03C 1/73; G03C 1/815; G03C 5/16; G03C 5/56

(52) U.S. Cl. ..... 430/138; 430/332; 430/335; 430/338; 430/339; 430/346; 430/512; 430/955; 430/958; 430/962; 430/964

(58) Field of Search ..... 430/335, 338, 430/339, 512, 955, 958, 962, 964, 332, 346, 138

(56) References Cited

U.S. PATENT DOCUMENTS

| | | | |
|---|---|---|---|
| 3,779,778 | 12/1973 | Smith et al. | 430/955 |
| 4,602,263 | 7/1986 | Borror et al. | 430/964 |
| 4,826,976 | 5/1989 | Borror et al. | 544/58.4 |
| 4,923,789 | 5/1990 | Yagihara et al. | 430/955 |
| 5,243,052 | 9/1993 | Taylor | 546/154 |
| 5,447,833 | 9/1995 | Motoki et al. | 430/958 |
| 5,679,494 | 10/1997 | Minami et al. | 430/512 |

*Primary Examiner*—Richard L. Schilling
(74) *Attorney, Agent, or Firm*—Birch, Stewart, Kolasch & Birch, LLP

(57) ABSTRACT

A thermal recording medium comprising a ultraviolet absorber precursor represented by formula (1-A) or an image forming compound changing hue and an acid, which is high in thermal sensitivity, recordable with such a low output laser that no ablation takes place even when a thermal heat mode image recording system using a laser is utilized, requiring no different receiving sheet, and excellent in keeping quality:

(1-A)

wherein P represents a protecting group for a hydroxyl group which is deblocked by heating to 250° C. or less in the presence of an acid; $R^1$ and $R^2$, which may be the same or different, each represents a substitutable group; and 1 and m each represents an integer of 0 to 4.

20 Claims, No Drawings

IMAGE RECORDING MEDIUM AND IMAGE RECORDING METHOD

This application is a divisional of copending application Ser. No. 09/120,175, filed on Jul. 22, 1998, now U.S. Pat. No. 6,063,539, the entire contents of which are hereby incorporated by reference.

FIELD OF THE INVENTION

The present invention relates to an image recording medium which can form an image in the ultraviolet region (360 nm to 420 nm) necessary for a platemaking film (a film for photomechanical process) and has high sensitivity and good keeping quality (preservability), and an image formation method thereof.

This invention relates to an image recording medium having high sensitivity and excellent shelf life, which contains a compound that changes its hue by the action of heat or acid. The instant invention also relates to an image recording medium which renders possible formation of images at the UV region (360–420 nm) necessary for plate making films and of images for visibility use. The instant invention further relates to a method for the image formation.

This invention relates to an image recording medium which uses a compound whose absorption between 360 to 900 nm changes by the action of heat or acid. It also relates to an image recording medium which can be applied to a dry system making use of laser. It further relates to an image recording medium having high sensitivity and excellent shelf life, which renders possible formation of images at the UV region (360–420 nm) necessary for plate making films and of images for visibility use and to a method for the image formation using the same.

BACKGROUND OF THE INVENTION

Thermal (heat-sensitive) recording materials express image areas and non-image areas as temperature difference distribution and a number of systems have been contrived, including fusion transfer and sublimation transfer of colorants, color development reaction between two components induced by heat fusion or breakage of capsules, and changes in optical characteristics by phase transition. Thermal recording media of this kind have been widely used as output materials for various printers, word processors and facsimile devices, because they have the advantages of producing recorded images by dry and simple systems and being maintenance-free as well. With the recent progress in laser recording equipment, their applications to optical disks and platemaking materials have also been investigated.

Although silver halide photosensitive materials requiring wet processing have been conventionally used as the platemaking materials, the development of dry processes has been desired from a request for simplification of processing steps and the problem of environmental pollution caused by processing solutions. Some technical proposals referring to thermal recording systems have recently been made. From the viewpoint of resolution, image recording with lasers is preferred, and for example, a system called dye ablation, in which a high output laser is used, has been developed. Recording materials used in the system are disclosed in JP-A-7-164755 (the term "JP-A" as used herein means an "unexamined published Japanese patent application"), JP-A-7-149063, JP-A-7-149065, and image formation devices in JP-A-8-48053, JP-A-8-72400. In this system, a recording material having a dye composition applied onto a support, said dye composition comprising an image dye, a substance having absorption in a laser wavelength region (infrared absorber) and a binder, is irradiated with a laser beam from the dye layer side thereof to achieve image recording. Energy given by a laser causes abrupt local changes at spots on the image forming layer which the laser beam strikes, thereby expelling substances from the layer. The above-mentioned patent specifications say that the changes are not completely physical ones (for example, fusion, evaporation or sublimation), but some kinds of chemical changes (for example, bond breakage), and that they are not partial removal of the image dye, but complete removal thereof. Such a dye ablation system has the disadvantages that a high output laser is indispensable to increase the efficiency of dye removal at sites exposed to the laser beam, and that a collector for collecting removed dye must also be installed.

As a system requiring no collector, U.S. Pat. No. 5,171,650 discloses an image recording method of an ablation transfer system in which a laser is used as a heat source. In this system, a dye donor sheet is used which comprises a dynamic separation layer coated with an ablative carrier topcoat, and an image is transferred to another receiving sheet which is aligned adjacent to the dye donor sheet. Accordingly, this system has the disadvantage of leaving a disused sheet as a waste material after image recording. In addition, also in this case, a high output laser is indispensable in order to increase transfer efficiency. Thus, customary thermal recording systems utilizing ablation with lasers have the disadvantages that the high output laser is needed, and that dust or waste materials are unavoidably generated.

Further, a thermal recording system developed from the system called "dry silver", without ablation utilizing a laser, is described in JP-A-6-194781. In this system, recording is conducted with a laser to a recording material comprising a thermally reducible silver source, a reducing agent for a silver ion and a light-heat conversion dye. However, the keeping quality of non-image areas and the heat sensitivity are practically insufficient.

Also, as other heat sensitive recording method which uses laser, compounds whose absorption changes by thermal decomposition of carbamate are described in U.S. Pat. No. 4,602,263 and U.S. Pat. No. 4,826,976. In addition, a compound which develops yellow color by thermal decomposition of an alkoxycarbonyl group introduced into hydroxyl group is described in U.S. Pat. No. 5,243,052, and compounds which develop yellow, magenta and cyan colors by thermal decomposition of an alkoxycarbonyl group introduced into hydroxyl group are described in JP-A-4-124175, JP-A-5-2748342, JP-A-6-227139, JP-A-5-281654 and JP-A-6-255256 (the term "JP-A" as used herein means an "unexamined published Japanese patent application"). Though these methods use an irreversible monomolecular reaction and are suited for laser-aided image recording for an extremely short period of time, their sensitivity is not sufficient so that more higher sensitivity is desired. In this connection, the alkoxycarbonyl group of the present invention is not described in these patents.

In addition, as a method for forming an ultraviolet mask image (360 nm to 420 nm; corresponding to an exposure light source to a presensitized plate) used for a platemaking material, no practical proposal has been made for the heat mode system utilizing a laser On the other hand, there are known benzotriazole compound-containing thermal recording materials described in JP-A-9-95487. However, the benzotriazole compounds described in this patent specification differ from those of the present invention, and are used as ultraviolet absorbers for improving the keeping quality of thermal recording images, but not for forming images to ultraviolet light.

SUMMARY OF THE INVENTION

An object of the present invention is to provide a novel thermal (heat-sensitive) recording medium high in thermal sensitivity, recordable (particularly, image recording corresponding to 360 nm to 420 nm which is indispensable to a platemaking mask film) with such a low output laser that no ablation takes place even when a thermal heat mode image recording system using a laser is utilized, requiring no different (separate) image receiving sheet, and excellent in keeping quality; and an image formation method thereof.

The object of the present invention has been achieved by a thermal recording medium and an image formation method described in 1) to 25) shown below:

1) An image recording medium comprising an ultraviolet absorber precursor represented by formula (1-A) and an acid:

(1-A)

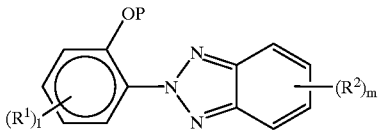

wherein P represents a protecting group for a hydroxyl group which is capable of being deblocked by heating to 250° C. or less in the presence of an acid; $R^1$ and $R^2$, which may be the same or different, each represents a substitutable group; 1 and m each represents an integer of 0 to 4; and when 1 or m is 2 or more, a plurality of groups represented by $R^1$ or $R^2$, which may be the same or different, may combine together to form a ring;

2) The image recording medium described in 1), in which P of the above-mentioned formula (1-A) is a secondary or tertiary alkoxycarbonyl group having a hydrogen atom at the β-position;

3) The thermal recording medium described in 1), in which said acid is a polymer;

4) The thermal recording medium described in 1), in which the ultraviolet absorber precursor represented by the above-mentioned formula (1-A) and the acid are separated from each other by use of microcapsules;

5) The thermal recording medium described in 1), in which the ultraviolet absorber precursor represented by the above-mentioned formula (1-A) and the acid are each applied onto different layers adjacent to each other;

6) A method for recording an image comprising subjecting the image recording medium described in 1) to scanning exposure with a laser beam; and 7) A method for recording an image comprising previously heating the thermal recording medium described in 4) or 5) over the entire surface thereof at 120° C. or less, and subjecting it to scanning exposure with a laser beam.

8) An image recording medium comprising a compound having an alkoxycarbonyl group P represented by formula (1-B) which is removed from the compound upon the action of heat or an acid, wherein the compound causes a change in the absorption region of 360 to 900 nm upon the bond cleavage of the alkoxycarbonyl group P or upon a following reaction to the bond cleavage of the alkoxycarbonyl group P:

P: (1-B)

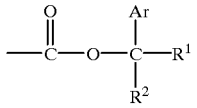

wherein, in formula (1-B) Ar represents an aryl group and $R^1$ and $R^2$ each represents a substitutable group.

9) The image recording medium described in 8), wherein the compound has a structure which can form a hydrogen bond within the molecule upon the cleavage of the alkoxycarbonyl group P represented by formula (1-B).

10) The image recording medium described in 8), wherein the compound is represented by formula (2-B):

$$P—X—Y^1—Y^2—Y^3—Z \quad (2\text{-B}):$$

wherein, in formula (2-B), P has the same meaning as in formula (1-B); X and Z each represents an oxygen atom or a nitrogen atom; when X or Z represents an nitrogen atom, the nitrogen atom may have a hydrogen atom or a substituent group if necessary; when Z represents an oxygen atom, the oxygen atom may have a hydrogen atom or a substituent group if necessary; $Y^1$, $Y^2$ and $Y^3$ each represents a nitrogen atom or a carbon atom, which may have a hydrogen atom or a substituent group if necessary; X, $Y^1$, $Y^2$, $Y^3$ and Z may combine to each other to form a ring; and the bonds of $X—Y^1$, $Y^1—Y^2$, $Y^2—Y^3$ and $Y^3—Z$ each may form a double bond.

11) The image recording medium described in 8), which further comprises an acid.

12) The image recording medium described in 11), wherein said acid is a polymer.

13) The image recording medium described in 8), wherein the compound is separated from the acid by encapsulating the compound in a microcapsule.

14) The image recording medium described in 8), wherein the compound and the acid are each applied onto different layers adjacent to each other.

15) A method for recording an image comprising subjecting the image recording medium described in 8) to scanning exposure with a laser beam.

16) A method for recording an image comprising preheating the thermal recording medium described in 13) or 14) over the entire surface thereof at 120° C. or less, and subjecting it to scanning exposure with a laser beam.

17) An image recording medium comprising a compound which causes cleavage of an acetal bond thereof upon the action of heat or an acid, wherein the compound causes a change in the absorption region of 360 to 900 nm upon the cleavage of the acetal bond or upon a following reaction to the cleavage of the acetal bond.

18) The image recording medium described in 17), wherein the compound is represented by formula (1-C):

(1-C)

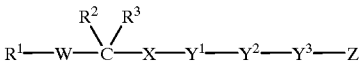

wherein, in formula (1-C), $R^1$ represents an alkyl group, an aryl group or a heterocycle; W represents an oxygen atom, a sulfur atom or $—N(R^0)—$ group; $R^2$, $R^3$ and $R^0$ each independently represents a hydrogen atom, an alkyl group, an aryl group or a heterocycle; X and Z each independently represents an oxygen atom or a nitrogen atom; when X or Z represents an nitrogen atom, the nitrogen atom may have a hydrogen atom or a substituent group if necessary; when Z represents an oxygen atom, the oxygen atom may have a hydrogen atom or a substituent group if necessary; $Y^1$, $Y^2$ and $Y^3$ each independently represents a nitrogen atom or a carbon atom, which may have a hydrogen atom or a substituent group if necessary; $R^1$, $R^2$, $R^3$, $R^0$, X, $Y^1$, $Y^2$, $Y^3$ and Z may combine to each other to form a ring; and the bonds of X—$Y^1$, $Y^1$—$Y^2$, $Y^2$—$Y^3$ and $Y^3$—Z each may form a double bond.

19) The image recording medium described in 17), wherein the compound is represented by formula (2-C):

(2-C)

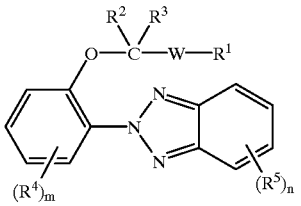

wherein, in formula (2-C), $R^1$, $R^2$, $R^3$ and W each has the same meaning as in formula (1-C); $R^4$ and $R^5$ each independently represents a substitutable group, and may combine to each other to form a ring; m and n each represents an integer of 0 to 4; and when m or n is 2 or more, a plurality of groups represented by $R^4$ or $R^5$ may be the same or different.

20) The image recording medium described in 17), which further comprises an acid.

21) The image recording medium described in 20), wherein said acid is a polymer.

22) The image recording medium described in 20), wherein the compound is separated from the acid by encapsulating the compound in a microcapsule.

23) The image recording medium described in 20), wherein the compound and the acid are each applied onto different layers adjacent to each other.

24) A method for recording an image comprising subjecting the image recording medium described in 20) to scanning exposure with a laser beam.

25) A method for recording an image comprising preheating the thermal recording medium described in 20) over the entire surface thereof at 120° C. or less, and subjecting it to scanning exposure with a laser beam.

DETAILED DESCRIPTION OF THE INVENTION

The present invention is described below in detail.

In the above-mentioned formula (1-A), P represents a protecting group for a hydroxy group which is deblocked at a temperature of 250° C. or less in the presence of an acid. In order to form images by the heat mode with lasers in thermal (heat-sensitive) recording materials, protecting groups eliminable at a temperature of 250° C. or less is effective. Although the lower limit is not particularly restricted, groups eliminable at a temperature of 60° C. or more is effective. P is more preferably a protecting group eliminable within the temperature range of from 60° C. to 200° C. in the presence of an acid, and most preferably a protecting group eliminable within the temperature range of from 80° C. to 150° under acidic conditions.

Examples of the protecting groups include acyl groups (for example, acetyl and benzoyl), cyclopropylmethyl groups, primary alkoxycarbonyl groups (for example, methoxycarbonyl and ethoxycarbonyl), secondary or tertiary alkoxycarbonyl groups each having a hydrogen atom at the β-position (for example, t-butoxycarbonyl, isopropyloxycarbonyl, 2-cyclohexenyloxycarbonyl), silyl groups (for example, trimethylsilyl, triethylsilyl, t-butyldimethylsilyl, t-butyldiphenylsilyl and phenyldimethylsilyl), and secondary or tertiary alkyl groups each having a hydrogen atom at the β-position (for example, t-butyl and 2-cyclohexenyl). Of these, secondary or tertiary alkoxycarbonyl groups each having a hydrogen atom at the β-position, silyl groups and secondary or tertiary alkyl groups each having a hydrogen atom at the β-position are preferred, and secondary or tertiary alkoxycarbonyl groups each having a hydrogen atom at the β-position are particularly preferred.

$R^1$ and $R^2$, which may be the same or different, each represents a substitutable group. Examples thereof include halogen atoms (for example, F, Cl and Br), nitro, cyano, alkyl groups (including groups having substituent groups and preferably having 1 to 40 carbon atoms, for example, methyl, ethyl, t-butyl, trifluoromethyl, chloromethyl and dimethylaminomethyl), aryl groups (including groups having substituent groups and preferably having 6 to 40 carbon atoms, for example, phenyl, naphthyl, 4-dimethylaminophenyl, 2-methoxyphenyl, 4-nitrophenyl and 3-sulfophenyl), alkenyl groups (including groups having substituent groups and preferably having 2 to 40 carbon atoms, for example, vinyl, 2-chlorovinyl, 2-dimethylaminovinyl, 2-phenylvinyl, 1-methylvinyl and allyl), alkynyl groups (including groups having substituent groups and preferably having 2 to 40 carbon atoms, for example, ethynyl and 1-propynyl), aralkyl groups (including groups having substituent groups and preferably having 7 to 40 carbon atoms, for example, benzyl), heterocyclic residues (including groups having substituent groups and preferably having 1 to 40 carbon atoms, for example, 2-pyridyl, 1-imidazolyl, benzothiazol-2-yl, morpholino, benzoxazol-2-yl, and 6-hexadecylsulfonylaminobenzothiazol-2-yl), —$N(R^7)_2$ [$R^7$ represents a hydrogen atom, an alkyl group (examples thereof are the same as given above for $R^1$ and $R^2$), aryl group (examples thereof are the same as given above for $R^1$ and $R^2$), alkenyl groups (examples thereof are the same as given above for $R^1$ and $R^2$), alkynyl groups (examples thereof are the same as given above for $R^1$ and $R^2$), aralkyl groups (examples thereof are the same as given above for $R^1$ and $R^2$) and heterocyclic residues (examples thereof are the same as given above for $R^1$ and $R^2$), and two groups represented by $R^7$, may be the same or different and may combine with each other to form a heterocycle], —$NHCOR^7$ ($R^7$ is the same as specified above), —$NHCOOR^7$ ($R^7$ is the same as specified above), —$CONHR^7$ ($R^7$ is the same as specified above), —$COOR^7$ ($R^7$ is the same as specified above), —$OR^7$ ($R^7$ is the same as specified above), and —$SR^7$ ($R^7$ is the same as specified above).

l and m each represents an integer of 0 to 4 and when l or m is 2 or more, a plurality of groups represented by $R^1$ or $R^2$ may be the same or different and may combine together to form a ring. When the rings are formed, 5- to 8-membered carbon rings or heterocycles are preferred.

A plurality of ultraviolet absorber precursors represented by the above-mentioned formula (1-A) may combine together through $R^1$ or $R^2$ to form a polymer. The molecular weight of the polymer preferably ranges from 1,000 to 1,000,000, and more preferably from 5,000 to 50,000. In this case, the polymer may be a homopolymer or a copolymer formed by polymerization with another monomer. Preferred examples of the monomers forming the copolymers include acrylic esters, methacrylic esters, acrylamides, styrene and vinyl ethers. In addition, the copolymer may also be formed with an acid group-containing monomer such as vinylphenol, vinyl benzoate or vinylbenzenesulfonic acid.

Examples of the ultraviolet absorber precursors represented by formula (1-A) of the present invention are shown below, but the present invention is not limited thereto.

(1)

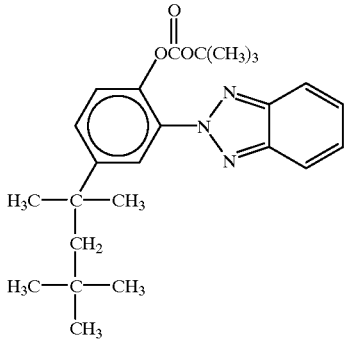

(2)

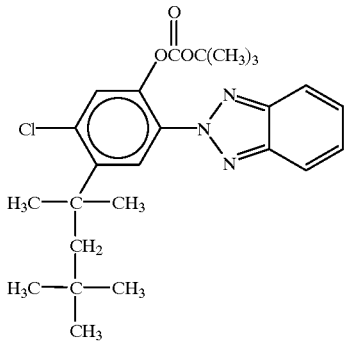

(3)

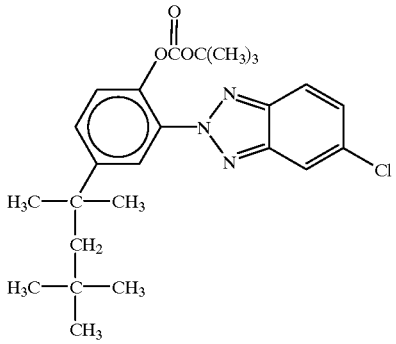

-continued (4)

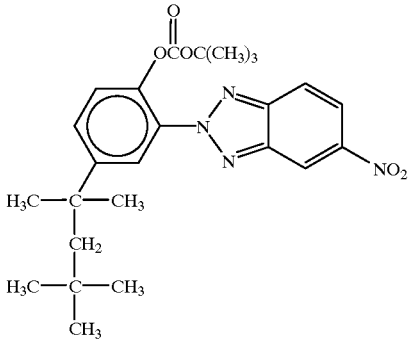

(5)

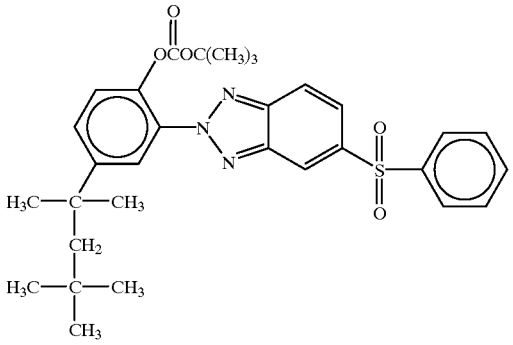

(6)

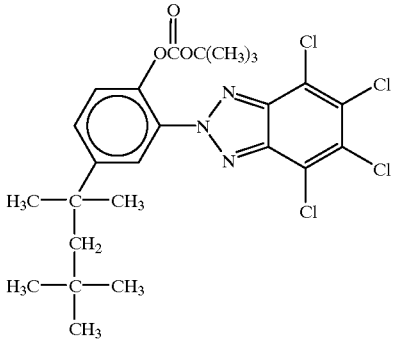

(7)

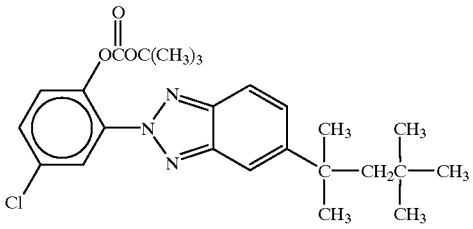

(8)

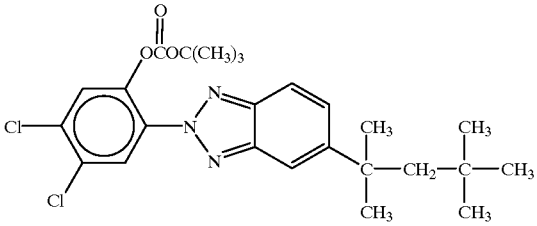

-continued
(9)
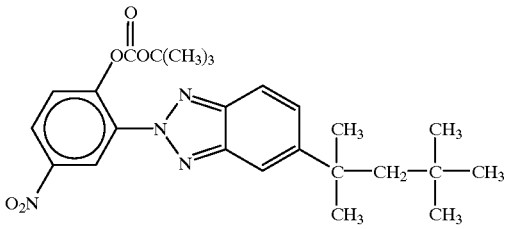
(10)
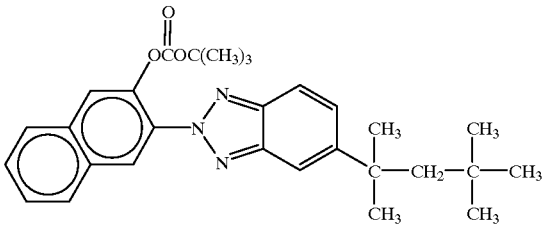
(11)
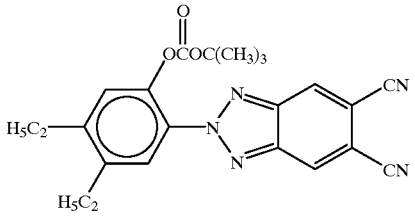
(12)
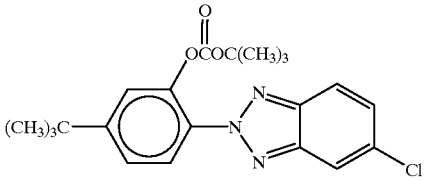
(13)
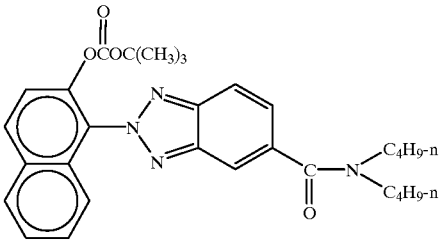
(14)
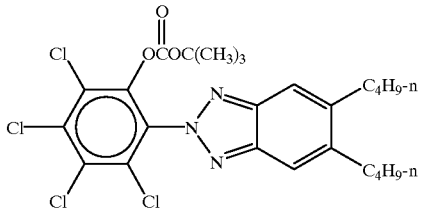
-continued
(15)
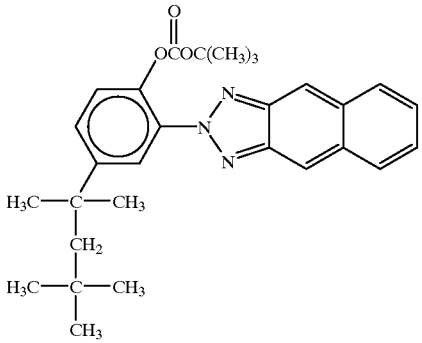
(16)
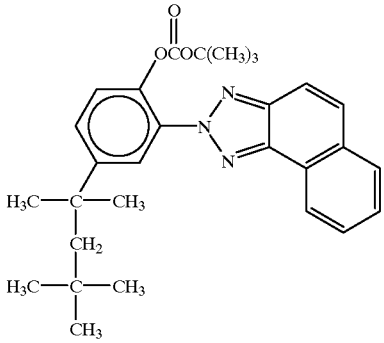
(17)
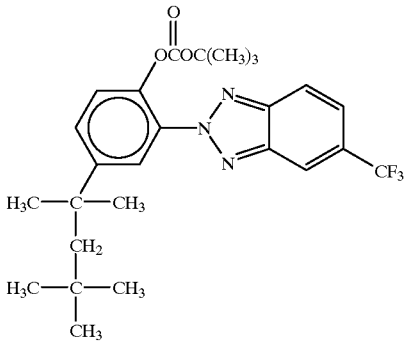
(18)
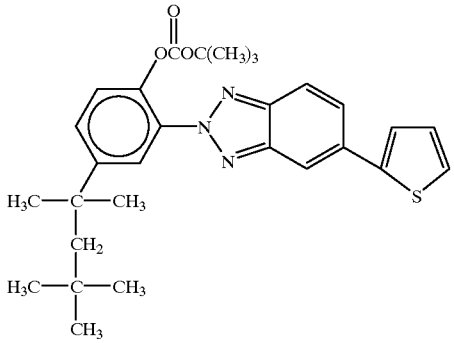

-continued
(19)
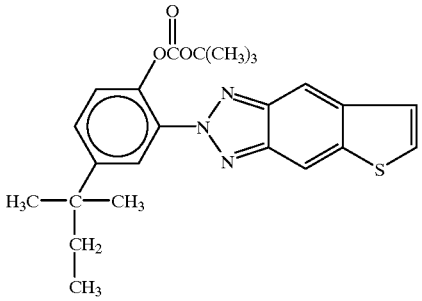
(20)
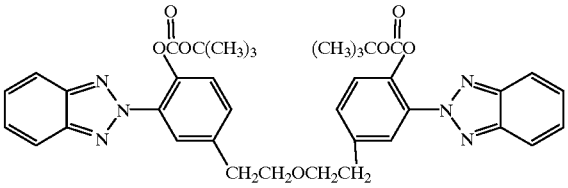
(21)
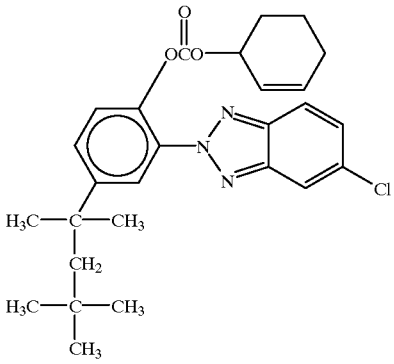
(22)
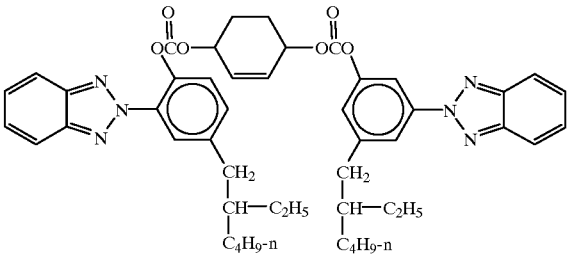
(23)
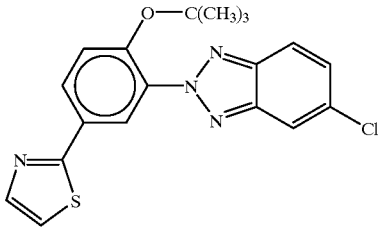
-continued
(24)
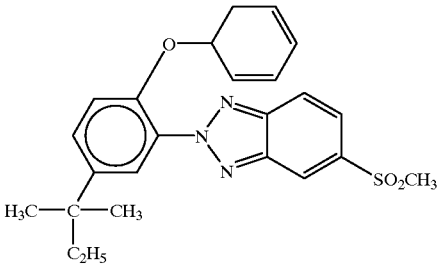
(25)
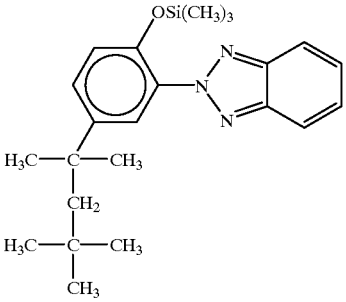
(26)
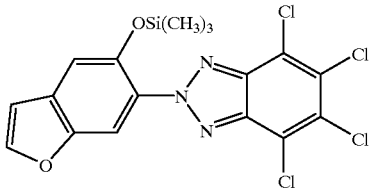
(27)
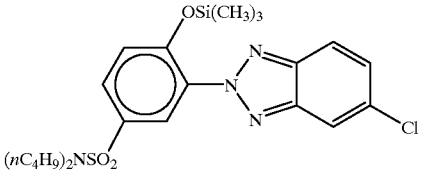
(28)
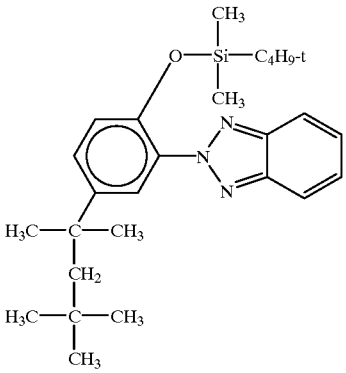

-continued
(29)
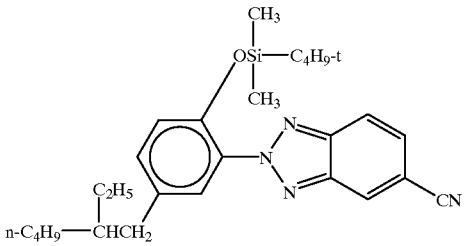
(30)
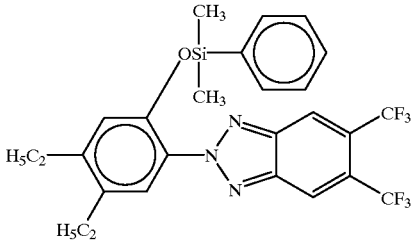
(31)
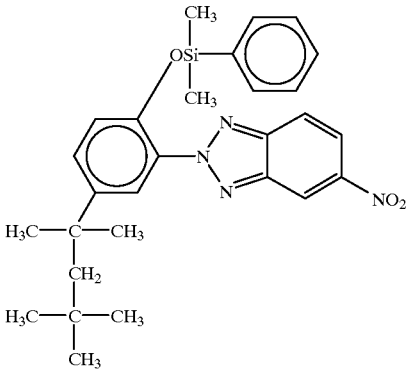
(32)
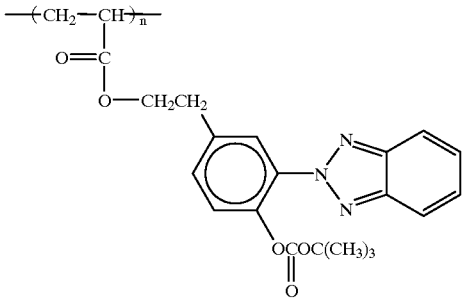
(33)
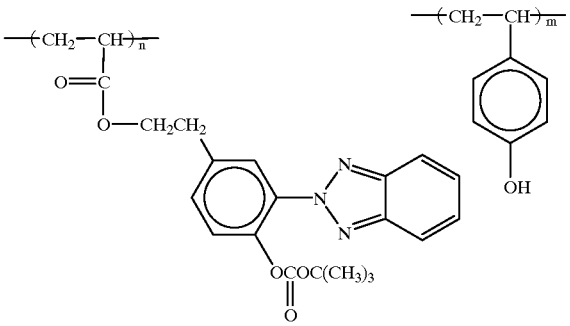
-continued
(34)
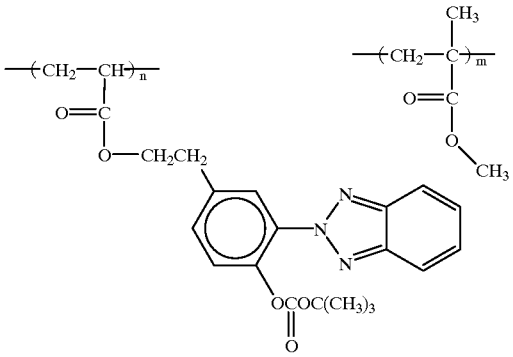
(35)
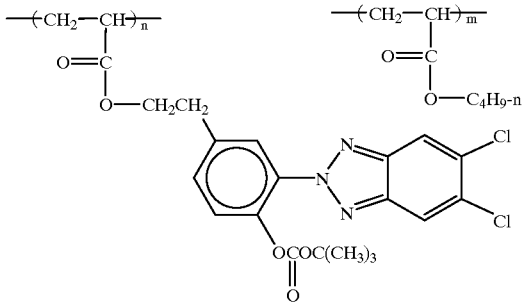
(36)
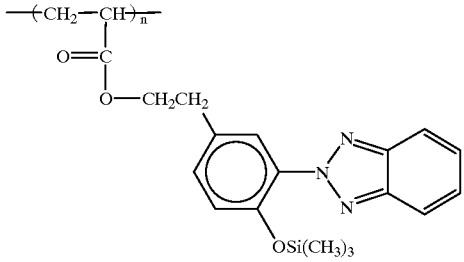
(37)
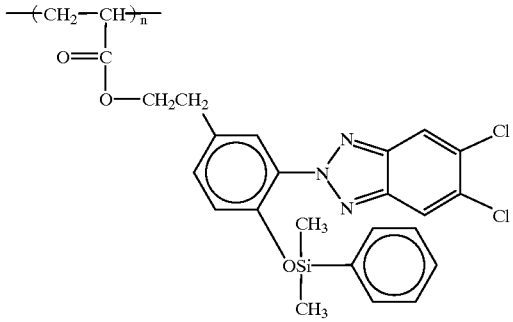

-continued (38)

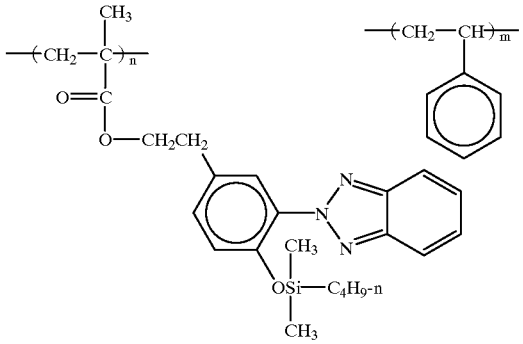

(39)

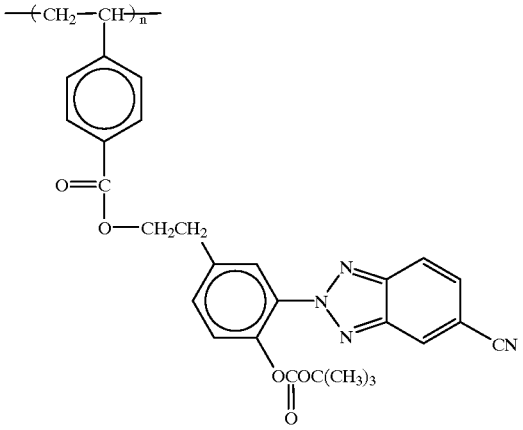

In the aforementioned general formula (1-B), Ar represents phenyl, naphthyl, furanyl, thienyl, pyridyl or the like aryl group, and it may have a substituent group at a substitutable position. Preferred examples of the substituent group include a halogen atom (for example, F, Cl, Br or the like), nitro group, cyano group, an alkyl group (which may have a substituent group and preferably have 1 to 40 carbon atoms, such as methyl, ethyl, t-butyl, trifluoromethyl, chloromethyl, dimethylaminomethyl or the like group), an aryl group (which may have a substituent group and preferably have 6 to 40 carbon atoms, such as phenyl, naphthyl, 4-dimethylaminophenyl, 2-methoxyphenyl, 4-nitrophenyl, 3-sulfophenyl or the like group), an alkenyl group (which may have a substituent group and preferably have 2 to 40 carbon atoms, such as vinyl, 2-chlorovinyl, 2-dimethylaminovinyl, 2-phenylvinyl, 1-methylvinyl, allyl or the like group), an alkynyl group (which may have a substituent group and preferably have 2 to 40 carbon atoms, such as ethynyl, 1-propynyl or the like group), an aralkyl group (which may have a substituent group and preferably have 7 to 40 carbon atoms, such as benzyl or the like group), a hetero ring residue (which may have a substituent group and preferably have 1 to 40 carbon atoms, such as 2-pyridyl, 1-imidazolyl, benzothiazol-2-yl, morpholino, benzoxazol-2-yl, 6-hexadecylsulfonylaminobenzothiazol-2-yl or the like group), —$N(R^3)_2$ {$R^3$ represents hydrogen atom, an alkyl group (its examples are the same as described in the foregoing), an aryl group (its examples are the same as described in the foregoing), an alkenyl group (its examples are the same as described in the foregoing), an alkynyl group (its examples are the same as described in the foregoing), an aralkyl group (its examples are the same as described in the foregoing) or a hetero ring residue (its examples are the same as described in the foregoing), and two of the $R^3$ group may be the same or different from each other and may form a hetero ring by binding to each other}; —$NHCOR^3$ ($R^3$ is as described in the foregoing), —$NHCOOR^3$ ($R^3$ is as described in the foregoing), —$CONHR^3$ ($R^3$ is as described in the foregoing), —$COOR^3$ ($R^3$ is as described in the foregoing), —$OR^3$ ($R^3$ is as described in the foregoing), or —$SR^3$ ($R^3$ is as described in the foregoing).

$R^1$ and $R^2$ represent substitutable groups which may be the same or different from each other and their examples include those which are described above as substituent groups of Ar, and particularly preferred is a case in which at least one of $R^1$ and $R^2$ is an alkyl group having hydrogen atom at the α-position (for example, methyl, ethyl, n-butyl or the like group).

The following describes illustrative examples of the alkoxycarbonyl group of the present invention represented by the general formula (1-B), though the invention is not restricted thereby.

(1)

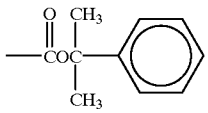

(2)

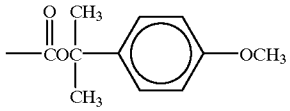

(3)

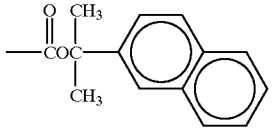

(4)

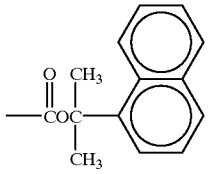

(5)

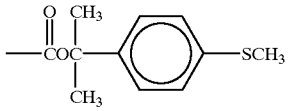

(6)

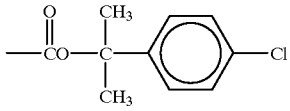

(7)

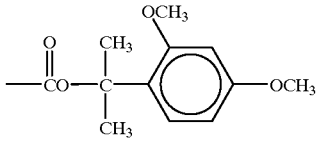

-continued
(8)
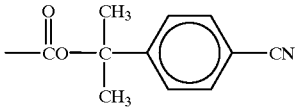
(9)
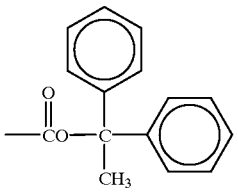
(10)
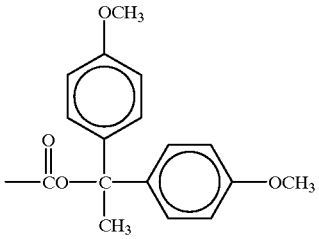
(11)
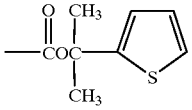
(12)
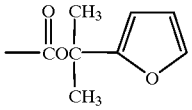
(13)
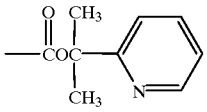
(14)
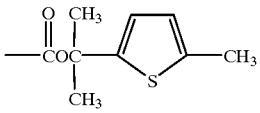
(15)
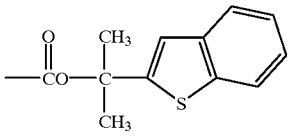
(16)
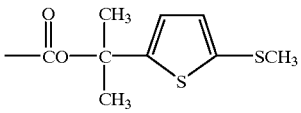
-continued
(17)
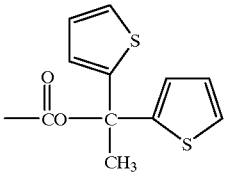
(18)
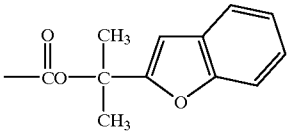
(19)
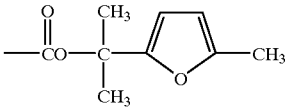
(20)
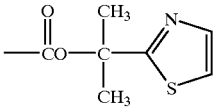
(21)
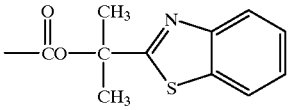
(22)
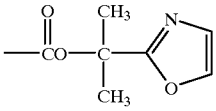
(23)
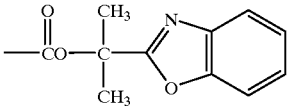
(24)
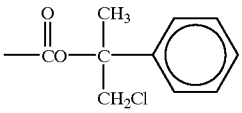
(25)
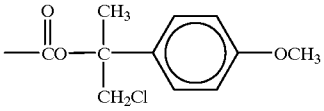
(26)
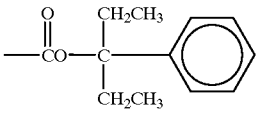

-continued (27)

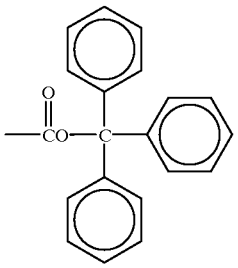

(28)

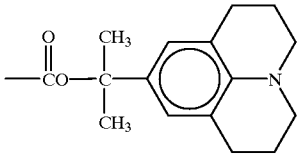

(29)

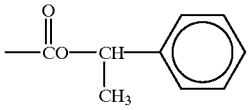

(30)

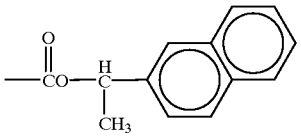

The compound to be used the image formation of the present invention is a compound which has a group (hydroxyl group, amino group or the like) substituted with P of the aforementioned general formula (I-B) and undergoes changes in its absorption within the range of from 360 to 900 nm due to expansion or shortening of the absorption wave length caused by bond cleavage of the alkoxycarbonyl group P by the action of heat or acid or caused by a succeeding reaction after the bond cleavage.

In this case, when the compound is used in a coloring type recording medium, it is desirable that the compound is such a type that it does not have absorption at 400 nm or more but generates absorption within 400 to 900 nm by bond cleavage of P or by a succeeding reaction after the bond cleavage. More desirably, it does not have absorption at 360 nm or more but generates absorption within 360 to 900 nm by bond cleavage of P or by a succeeding reaction after the bond cleavage.

When the compound is used in an achromatic type recording medium, it is desirable that the compound is such a type that its absorption at 400 to 900 nm becomes an absorption of 400 nm or less by bond cleavage of P or by a succeeding reaction after the bond cleavage. More desirably, its absorption at 360 to 900 nm becomes an absorption of 360 nm or less by bond cleavage of P or by a succeeding reaction after the bond cleavage.

In addition, the compound to be used in the image formation of the present invention is divided into two types, namely a type in which a change occurs within the absorption range of from 360 to 900 nm due to expanded or shortened wave length of the absorption caused by decomposition of P (type 1) and a type in which a change occurs within the just described absorption range caused by a succeeding reaction after the decomposition of P (type 2).

A compound in which its-amino group, hydroxyl group or the like auxochrome is substituted with P can be exemplified as the type 1 compound, and an example of the compound whose absorption becomes longer wave length caused by the decomposition of P is preferably a compound whose wave length becomes longer through the formation of hydrogen bond in the molecule caused by the decomposition of P, more preferably a compound which forms a 5-membered or six-membered ring by hydrogen bonding in the molecule.

The structure represented by the aforementioned general formula (2-B) can be exemplified as a particularly preferred mode. The structure represented by the formula (2-B) forms a six-membered ring by intramolecular hydrogen bonding. When X, $Y^1$, $Y^2$, $Y^3$ or Z in the formula (2-B) has a substituent group, its examples include the substituent groups of Ar in P of the general formula (1-B) and those which are described as the case of $R^1$ and $R^2$.

The following compounds LD-(1) to LD-(33) are given as illustrative examples of a type 1 compound whose wave length becomes long by the decomposition of P, though the present invention is not restricted thereby.

LD-(1)

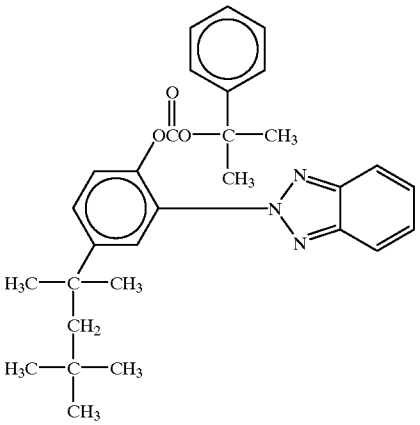

LD-(2)

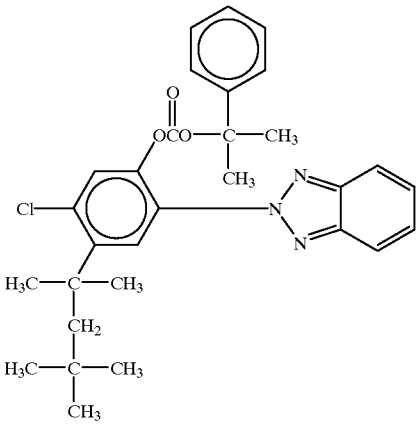

-continued
LD-(3)
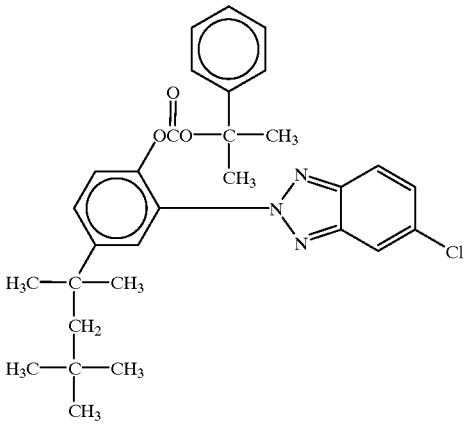
LD-(4)
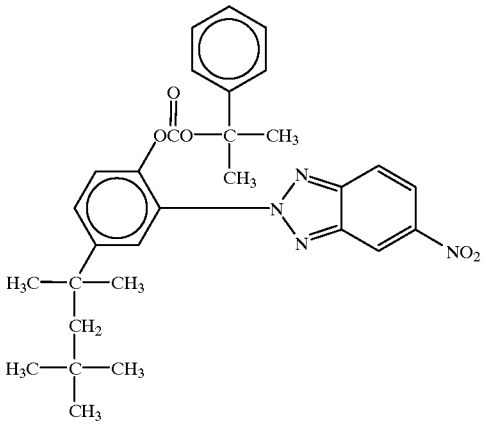
LD-(5)
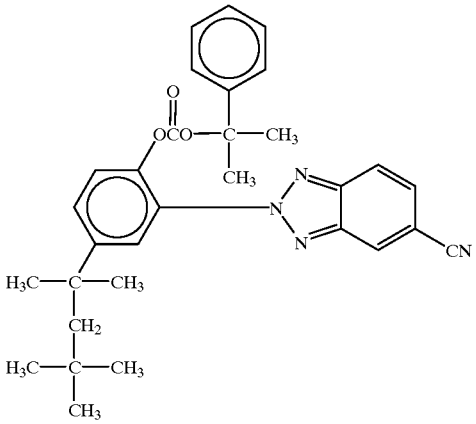
LD-(6)
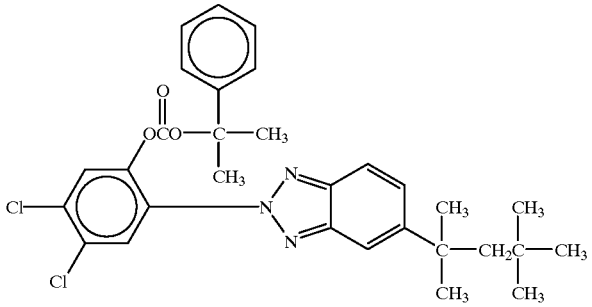
LD-(7)
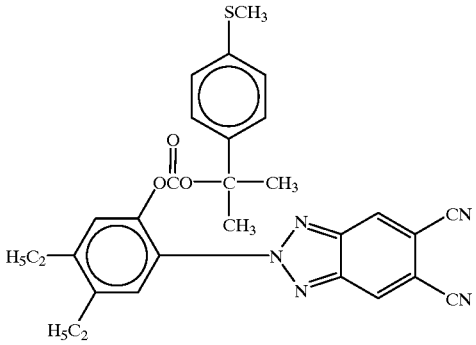
LD-(8)
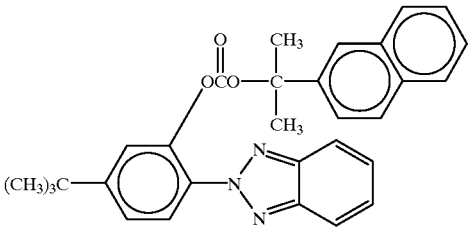
LD-(9)
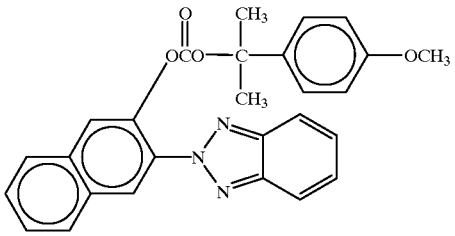
LD-(10)
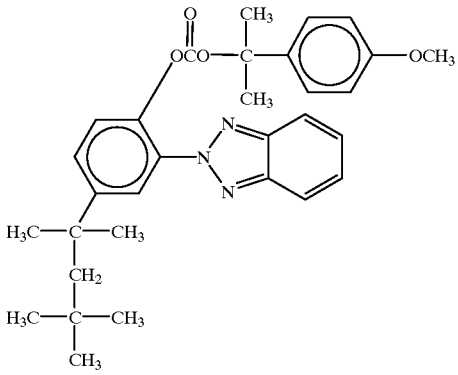

-continued
LD-(11)
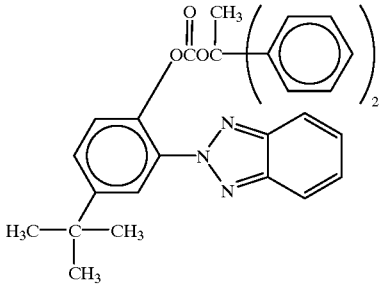
LD-(12)
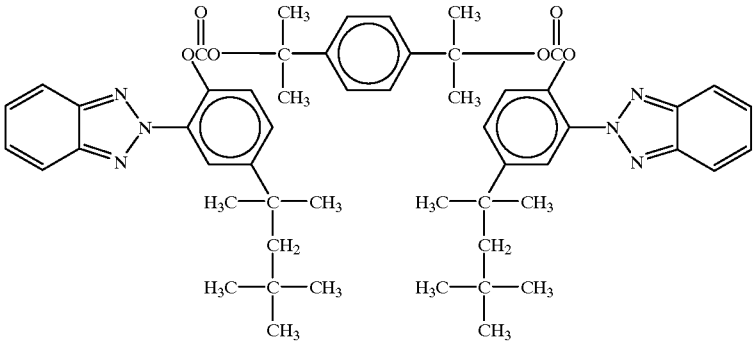
LD-(13)
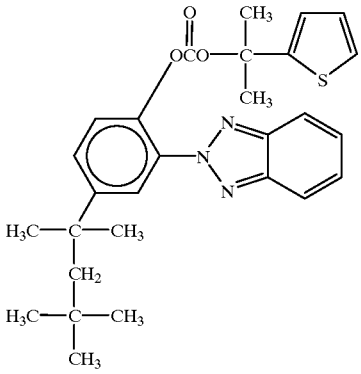
LD-(14)
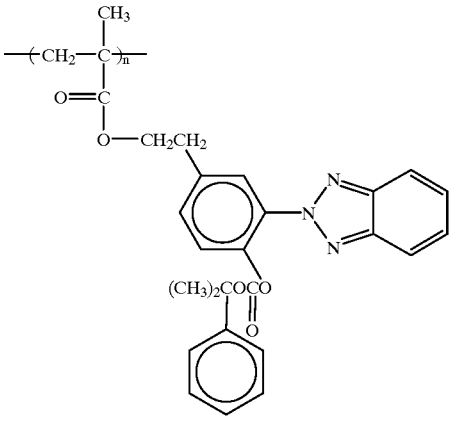
LD-(15)
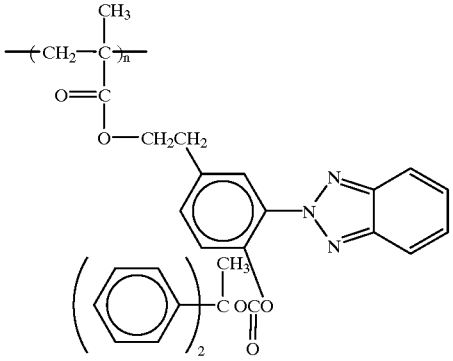
LD-(16)
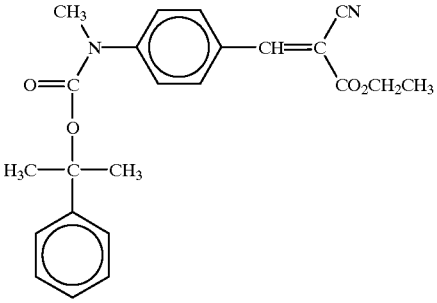

-continued
LD-(17)
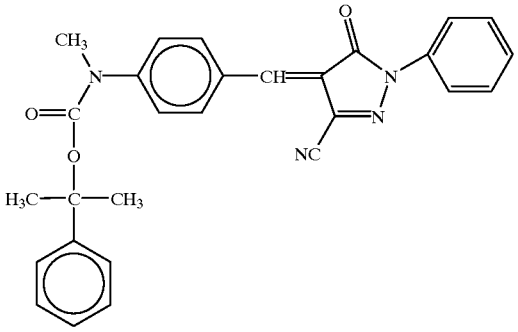
LD-(18)
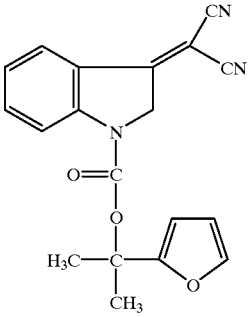
LD-(19)
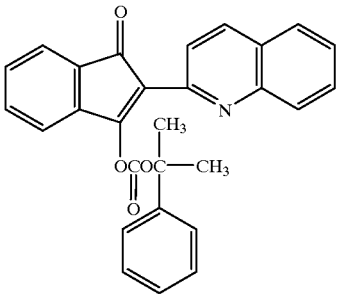
LD-(20)
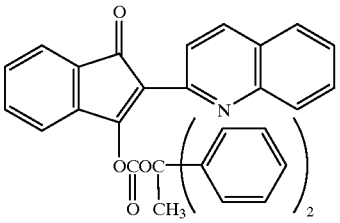
LD-(21)
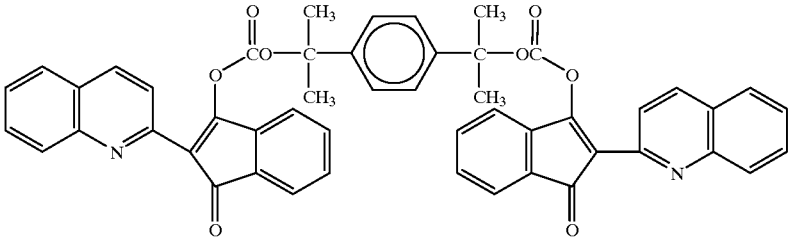
LD-(22)
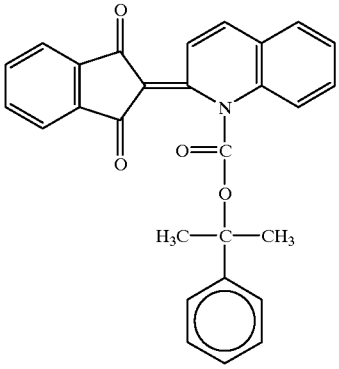
LD-(23)
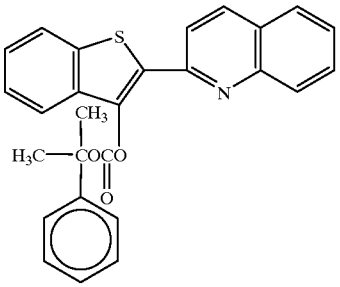
LD-(24)
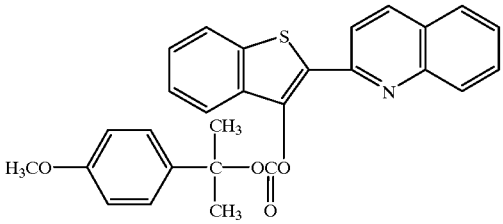
LD-(25)
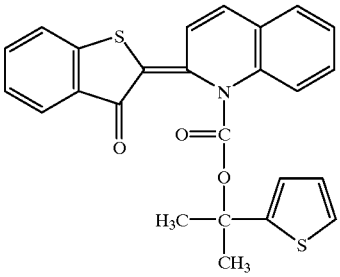

-continued
LD-(26)
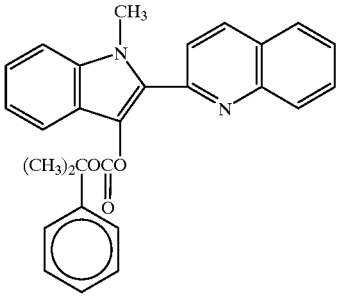
LD-(27)
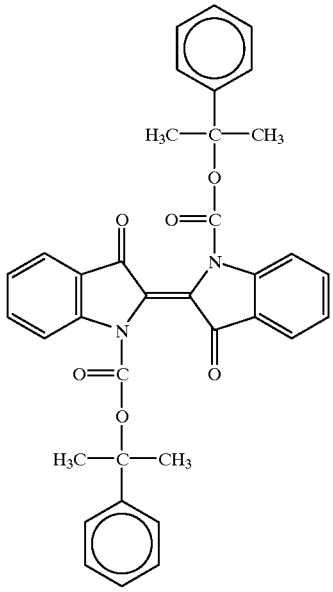
LD-(28)
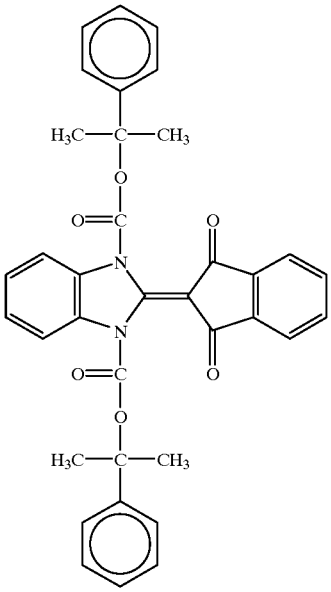
LD-(29)
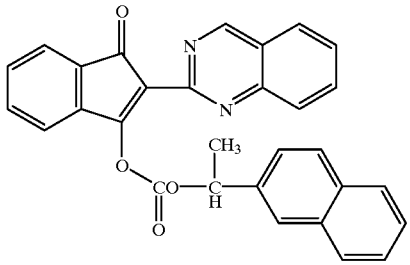
LD-(30)
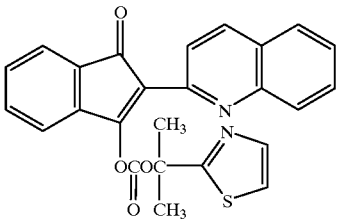
LD-(31)
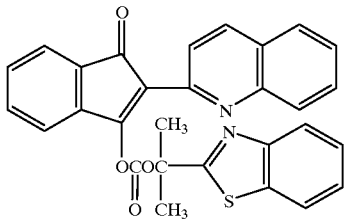

LD-(32)

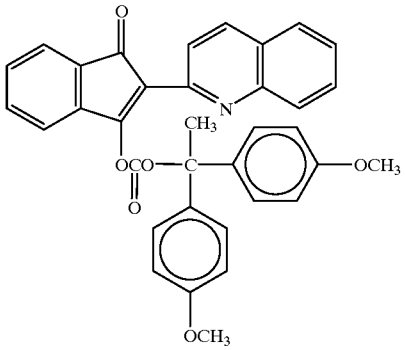

With regard to the succeeding reaction after the decomposition of P in the type 2 compound, an oxidation reaction, an elimination reaction, an intramolecular ring closure or ring opening reaction, an intermolecular coupling reaction and the like can be exemplified.

-continued

LD-(33)

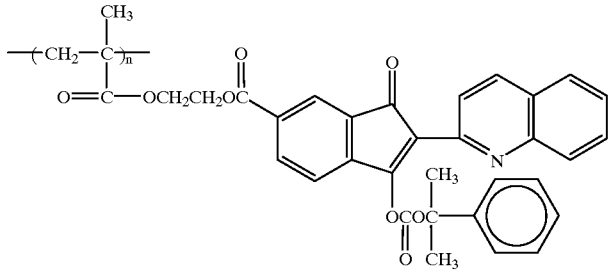

The following compounds LD-(34) to LD-(46) are given as illustrative examples of the type 2 compound, though the present invention is not restricted thereby.

LD-(34)

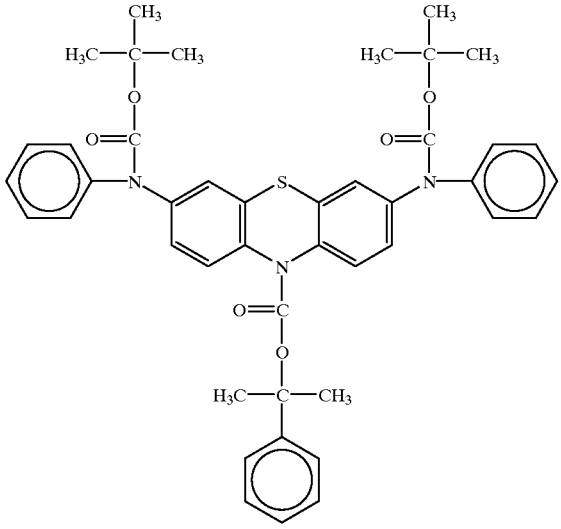

LD-(35)

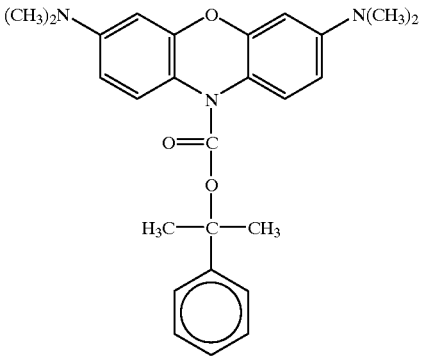

-continued
LD-(36)
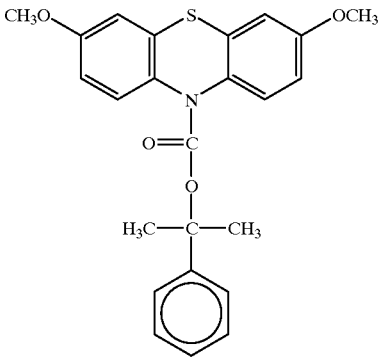
LD-(37)
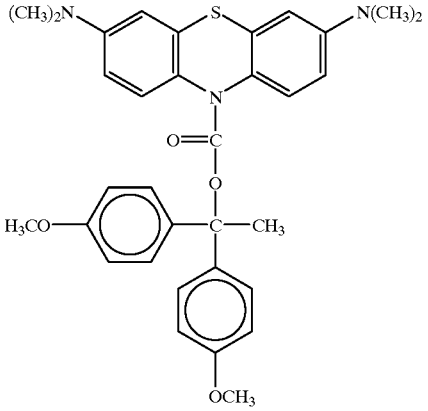
LD-(38)
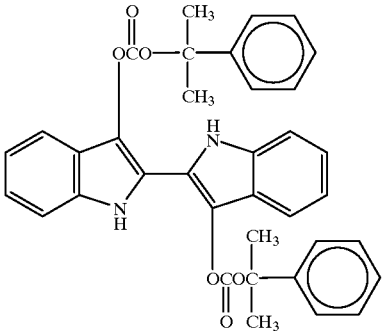
LD-(39)
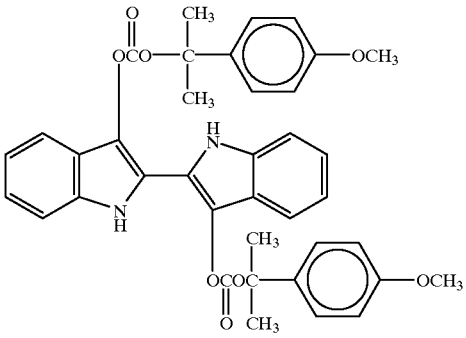

-continued
LD-(40)
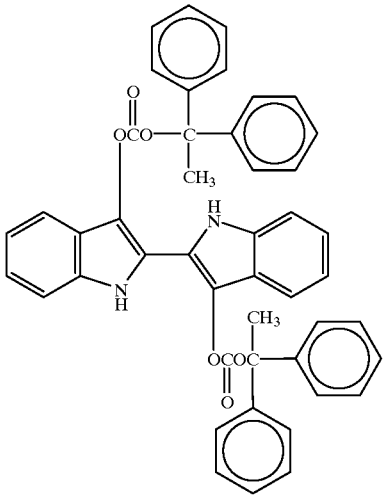
LD-(41)
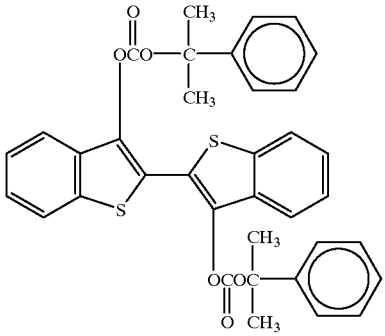
LD-(42)
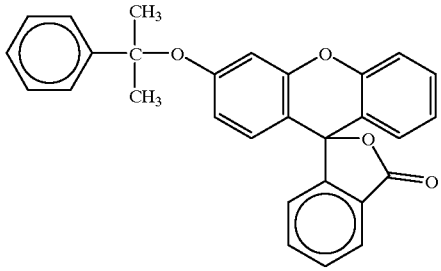
LD-(43)
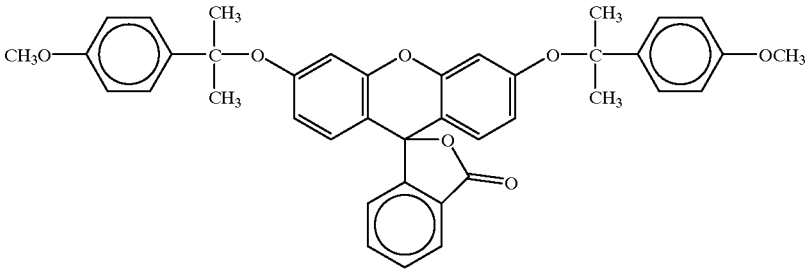

-continued

LD-(44)

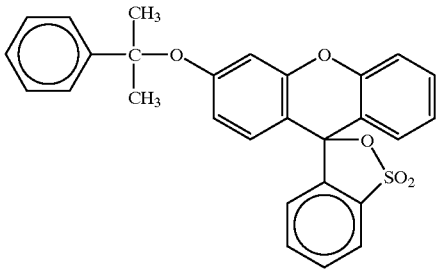

LD-(45)

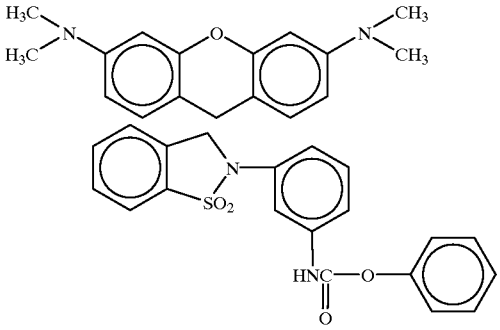

LD-(46)

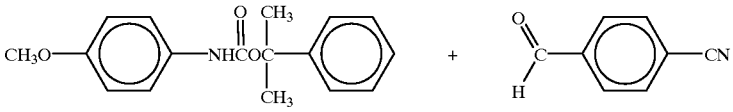

In addition, a compound which becomes short-waved by a succeeding conjugate system-cleaving reaction which occurs after the decomposition of P is also included in the present invention. The following compounds LD-(47) to LD-(53) are given as illustrative examples of such a compound, though the present invention is not restricted thereby.

LD-(47)

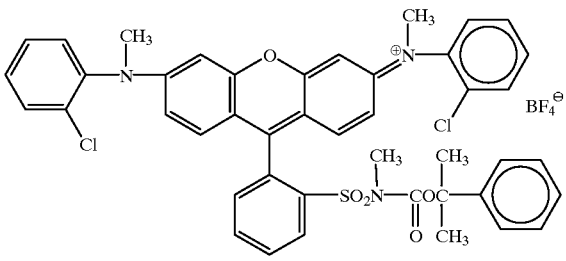

-continued

LD-(48)

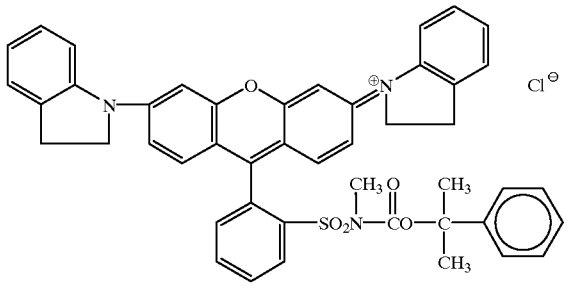

LD-(49)

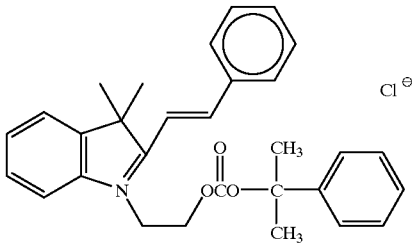

-continued
LD-(50)
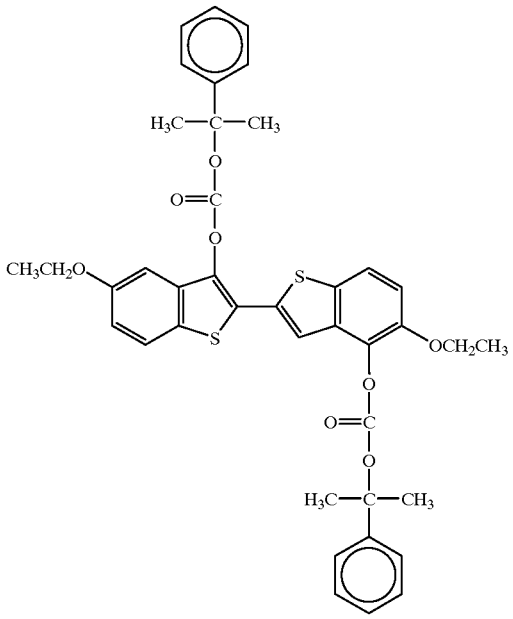
LD-(51)
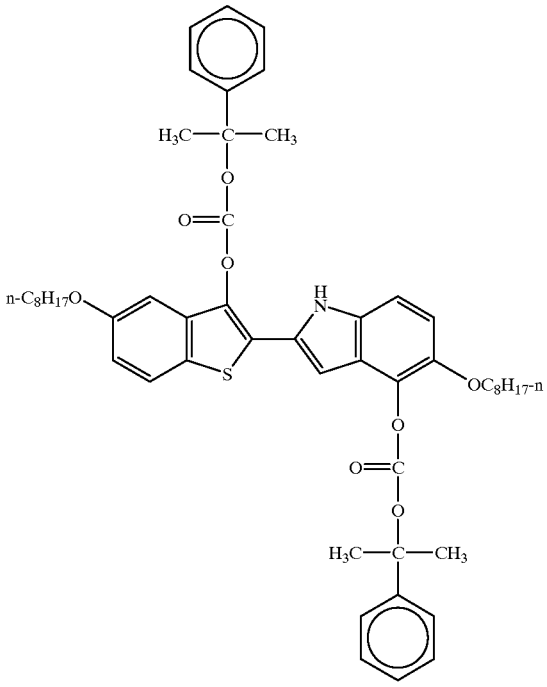
-continued
LD-(52)
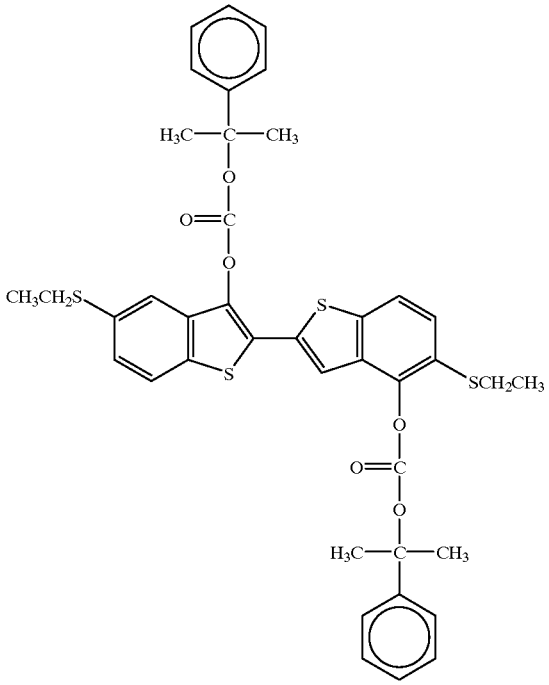
LD-(53)
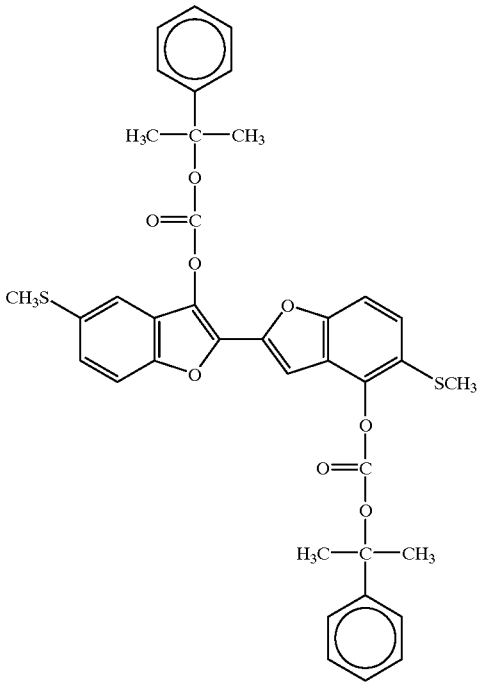

The compound of the present invention represented by the general formula (1-B) can be synthesized for example by allowing a carbonic ester represented by PO(C=O)OPh (which is synthesized by the method described in *Int. J. Peptide Protein Res.*, 6, 111–119 (1974), *Aust. J. Chem.*, 44, 377–387 (1991) or the like) to react with amino group or hydroxyl group of a pigment or pigment precursor molecule in the presence of sodium hydride, t-butoxy potassium, DBU or the like base.

Decomposition of P in the compound of the present invention represented by the general formula (1-B) occurs by the action of heat alone, but the activation energy can be reduced sharply by the coexistence of an acid catalyst.

The acetal compound of the present invention is a compound which undergoes changes in its absorption within the range of from 360 to 900 nm due to expansion or shortening of the absorption wave length caused by the bond cleavage of acetal bond by the action of heat or acid or caused by a succeeding reaction after the bond cleavage.

In this case, when the compound is used in a coloring type recording medium, it is desirable that the compound is such a type that it does not have absorption at 400 nm or more but generates absorption within 400 to 900 nm by bond cleavage of the acetal bond or by a succeeding reaction after the bond cleavage. More desirably, it does not have absorption at 360 nm or more but generates absorption within 360 to 900 nm by bond cleavage of the acetal or by a succeeding reaction after the bond cleavage.

When the compound is used in an achromatic type recording medium, it is desirable that the compound is such a type that its absorption at 400 to 900 nm becomes an absorption of 400 nm or less by bond cleavage of the acetal bond or by a succeeding reaction after the bond cleavage. More desirably, its absorption at 360 to 900 nm becomes an absorption of 360 nm or less by bond cleavage of the acetal bond or by a succeeding reaction after the bond cleavage.

In addition, the acetal compound of the present invention is divided into two types, namely a type in which a change occurs within the absorption range of from 360 to 900 nm due to expanded or shortened wave length of the absorption caused by the cleavage of acetal bond (type 1) and a type in which a change occurs within the just described absorption range caused by a succeeding reaction after the decomposition of acetal bond (type 2).

A compound in which its amino group, hydroxyl group or the like auxochrome is substituted with an acetal bond residue can be exemplified as the type 1 compound, preferably a compound which becomes fairly long-waved caused by the formation of hydrogen bond in the molecule through cleavage of the acetal bond, more preferably a compound which forms a 5-membered or six-membered ring by hydrogen bonding in the molecule.

With regard to the succeeding reaction after cleavage of the acetal bond in the type 2 compound, an oxidation reaction, an elimination reaction, an intramolecular ring closure or ring opening reaction, an intermolecular coupling reaction and the like can be exemplified.

In addition, a compound whose absorption is short-waved by a succeeding conjugate system-cleaving reaction which occurs after the cleavage of acetal bond is also included in the present invention.

A compound represented by the aforementioned general formula (1-C) can be exemplified as a preferred mode of the acetal compound which is type 1 and long-waved by the cleavage of acetal bond. The compound represented by the formula (1-C) forms a six-membered ring by intramolecular hydrogen bonding.

In the general formula (1-C), $R^1$ represents an alkyl group (such as methyl, isopropyl, t-butyl, octyl, 2-ethylhexyl, dodecyl or the like), an aryl group (such as phenyl, 1-naphthyl, 2-naphthyl or the like) or a heterocyclic group (such as thienyl, furyl, pyrrolyl, pyrazolyl, thiazolyl, isothiazolyl, oxazolyl, isoxazolyl, pyridyl, pyrazyl, pyrimidinyl, indolyl, quinazolyl, benzothiazolyl, benzoxazolyl (each of these may be substituted at a possible position) or the like). These may have a substituent group, and examples of the substituent group include a halogen atom (such as fluorine, chlorine, bromine or iodine), an alkyl group (its illustrative examples are as described above), an alkenyl group (such as vinyl, allyl or 2-phenylvinyl), an alkynyl group (such as ethynyl, 1-propynyl or 2-phenylethynyl), an aryl group (its illustrative examples are as described above), a heterocyclic group (its illustrative examples are as described above), an alkoxy group (such as methoxy, ethoxy, isopropoxy, t-butoxy or 2-ethyloctyloxy), an aryloxy group (such as phenoxy), an alkoxycarbonyl group (such as ethoxycarbonyl, isopropoxycarbonyl or decyloxycarbonyl) , phenoxycarbonyl group, a —CON($R^{11}$)$R^{12}$ group (each of $R^{11}$ and $R^{12}$ independently represents hydrogen atom, an alkyl group or an aryl group and their illustrative examples are as described in the foregoing; the same shall apply hereinafter), a —N($R^{11}$)COR$^{12}$ group, a —$SO_2$N($R^{11}$)$R^{12}$ group, a —N($R^{11}$)$SO_2R^{12}$ group, a —$SR^{13}$ group ($R^{13}$ represents an alkyl group or an aryl group and their illustrative examples are as described in the foregoing; the same shall apply hereinafter), a —CONR$^{11}$ group, a —Si($R^{13}$)($R^{14}$)$R^{15}$ group ($R^{14}$ and $R^{15}$ are synonymous with $R^{13}$), cyano group, hydroxyl group, carboxyl group, nitro group, a —N($R^{11}$)$R^{12}$ group and the like.

W represents oxygen atom, sulfur atom or —N($R^0$)— group. Each of $R^2$, $R^3$ and $R^0$ independently represents hydrogen atom, an alkyl group, an aryl group or a heterocyclic group, and their illustrative examples are as described in the foregoing.

Each of X and Z independently represents oxygen atom or nitrogen atom. When X and/or Z is nitrogen atom, the nitrogen atom may have hydrogen atom or a substituent group as occasion demands. Illustrative examples of the substituent group are as described in the foregoing. Also, when Z is oxygen atom, the oxygen atom may have hydrogen atom or a substituent group as occasion demands. Illustrative examples of the substituent group are as described in the foregoing.

Each of $Y^1$, $Y^2$ and $Y^3$ independently represents carbon atom or nitrogen atom, and these atoms may have hydrogen atom or a substituent group as occasion demands. Illustrative examples of the substituent group are as described in the foregoing.

Also $R^1$, $R^2$, $R^3$, $R^0$, X, $Y^1$, $Y^2$, $Y^3$ and Z may be linked to one another to form a ring. In addition, linkage of X—$Y^1$, $Y^1$—$Y^2$, $Y^2$—$Y^3$ and $Y^3$—Z may form double bond.

Among compounds represented by the general formula (1-C), a compound represented by the aforementioned general formula (2-C) is particularly desirable.

In the general formula (2-C), $R^1$, $R^2$, $R^3$ and W are synonymous with those of the general formula (1-C). Each of $R^4$ and $R^5$ independently represents a substitutable group, and they may be linked to each other to form a ring. As the substituent group, those which are described in the general formula (1-C) can be exemplified. Each of m and n is an integer of from 0 to 4, and when m or n is an integer of 2 or more, a plurality of $R^4$ or $R^5$ may be the same or different from one another. Each of m and n is preferably an integer of from 0 to 2.

The acetal compound of the present invention may form a polymer through bonding of a plurality of molecules. In that case, molecular weight of the polymer may be preferably within the range of from 1,000 to 1,000,000, more preferably within the range of from 5,000 to 50,000. Also, the polymer may be a homopolymer or a copolymer with other monomer. An acrylic ester, a methacrylic ester, acrylamide, a vinyl ether, styrene and the like are desirable as the monomer to be used in the formation of a copolymer.

Illustrative examples of the acetal compound of the present invention and the compound represented by the general formula (1-C) or (2-C) are shown in the following, though the present invention is not restricted thereby. In this connection, among the following compounds, the compounds of (37C), (45C) to (48C) and (51C) to (57C) are examples of the compound corresponding to the aforementioned type 2, and the compounds of (58C) to (60C) are examples of the compound whose absorption is short-waved by the cleavage of acetal bond.

(1C)

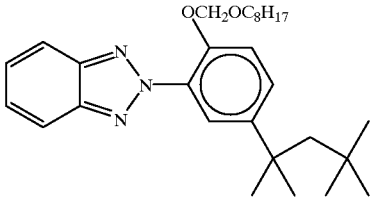

(2C)

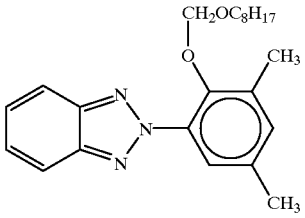

(3C)

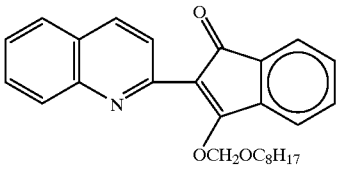

(4C)

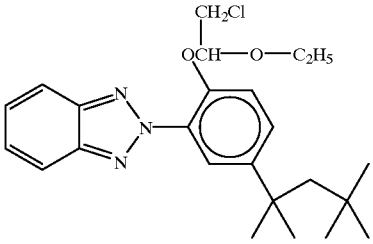

-continued (5C)

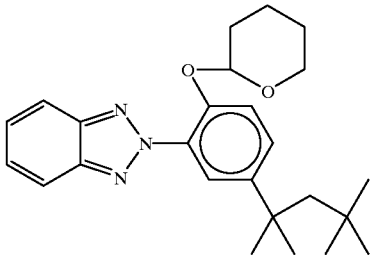

(6C)

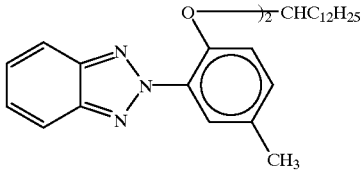

(7C)

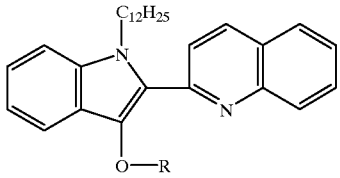

(8C)

R = —$CH_2OC_8H_{17}$ (9C)

R = —CH($OC_{12}H_{25}$)—$CH_3$ (10C)

R = —$CH_2$OCH($C_6H_{13}$)—$CH_3$ (11C)

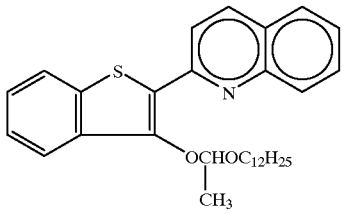

(12C)

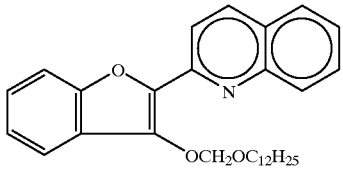

(13C)

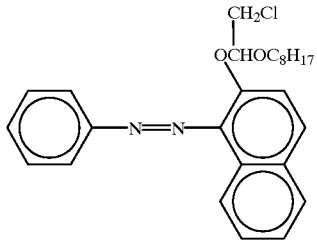

-continued
(14C)
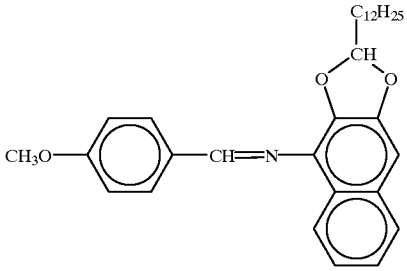
(15C)
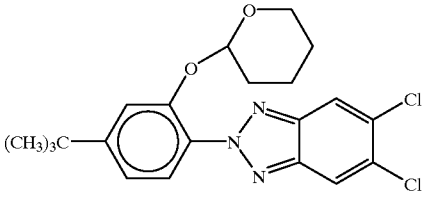
(16C)
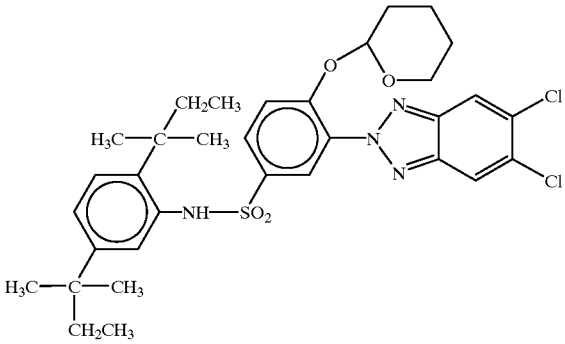
(17C)
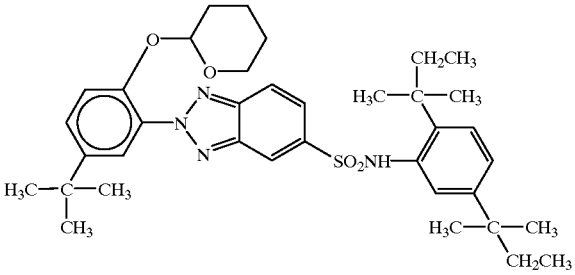
(18C)
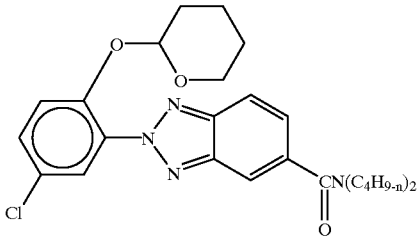
-continued
(19C)
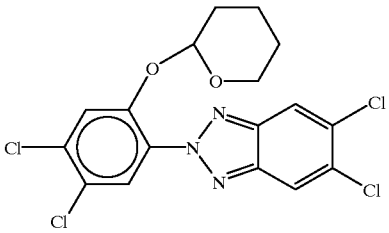
(20C)
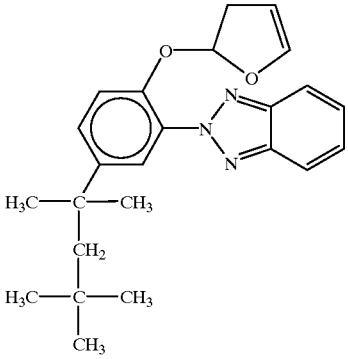
(21C)
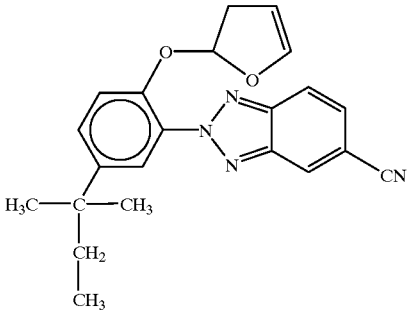
(22C)
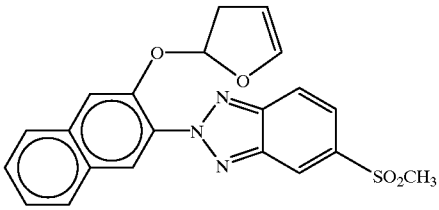
(23C)
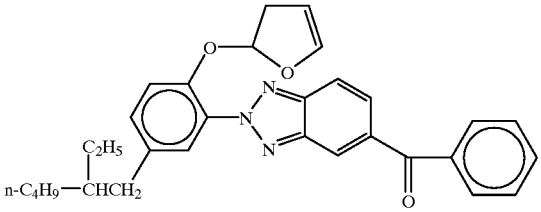

-continued
(24C)
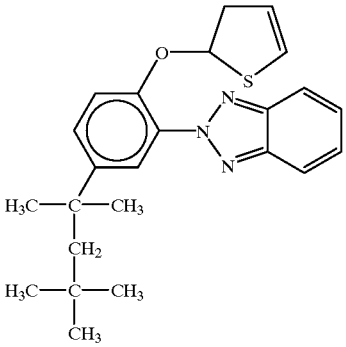
(25C)
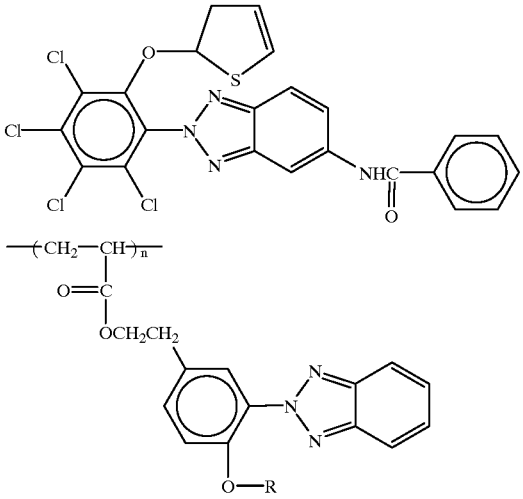
(26C)
R = $—CH_2OC_8H_{17}$
(27C)
R = $—CH_2OCH_3$
(28C)
R = 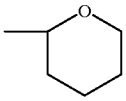
(29C)
R = $—CH_2OCH_2CH_2OC_{12}H_{25}$
(30C)
R = $—CH_2SC_{12}H_{25}$
(31C)
R = $—CH_2—N(C_2H_5)_2$
(32C)
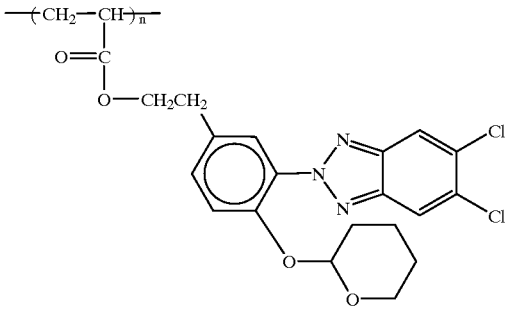
-continued
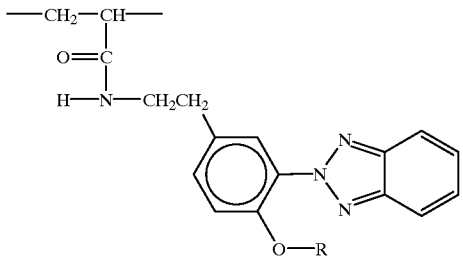
(33C)
R = $—CH_2OC_8H_{17}$
(34C)
R = $—CH_2SC_{12}H_{25}$
(35C)
R = 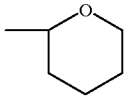
(36C)
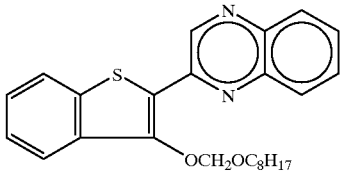
(37C)
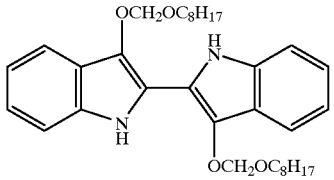
(38C)
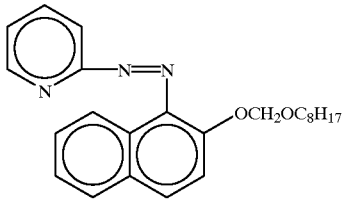
(39C)
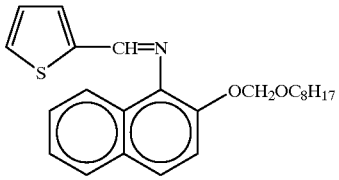
(40C)
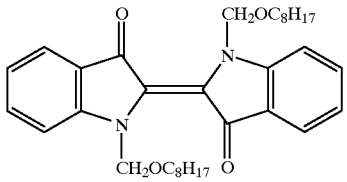

-continued
(41C)
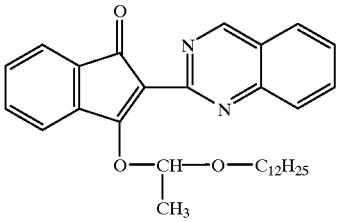
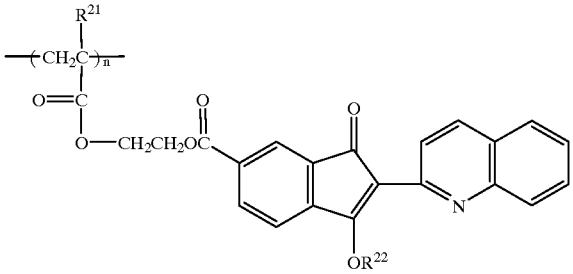
(42C)
$R^{21} = CH_3$ $R^{22} = —CH_2OC_8H_17$
(43C)
$R^{21} = H$ $R^{22} = —CH_2OC_8H_17$
(44C)
$R^{21} = CH_3$ $R^{22} = —CHSC_{12}H_{25}$ ($CH_3$)
(45C)
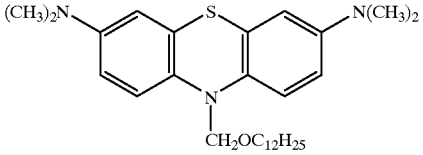
(46C)
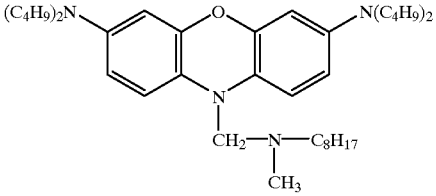
(47C)
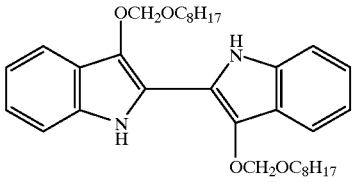
(48C)
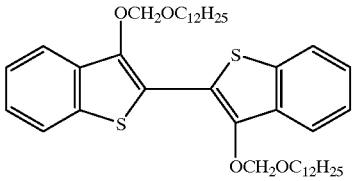
-continued
(49C)
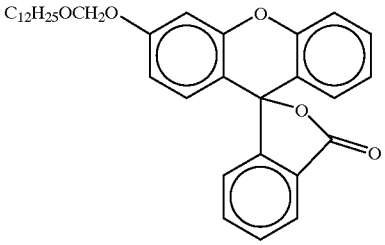
(50C)
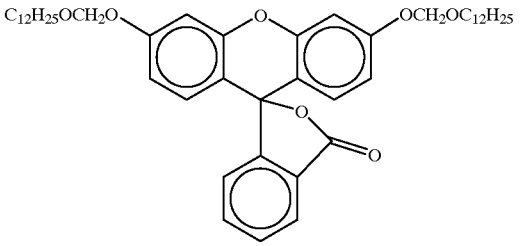
(51C)
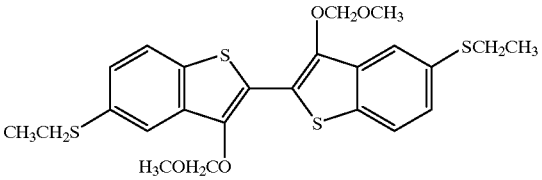
(52C)
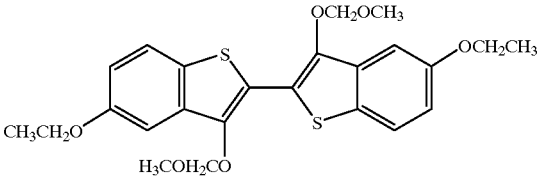
(53C)
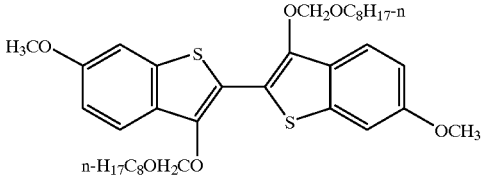
(54C)
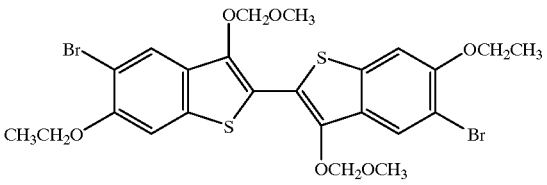
(55C)
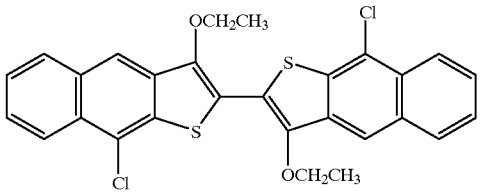

-continued (56C)

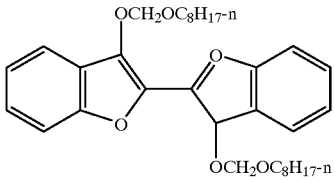

(57C)

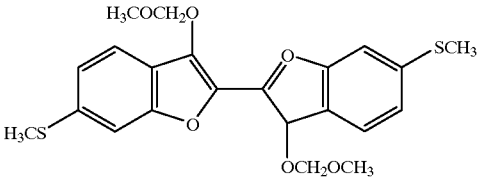

(58C)

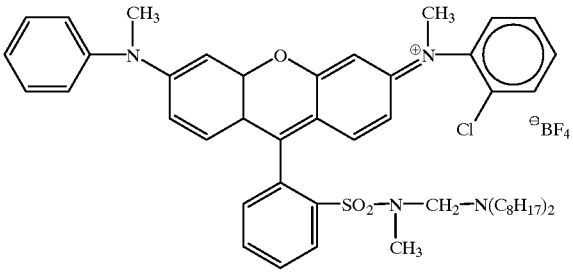

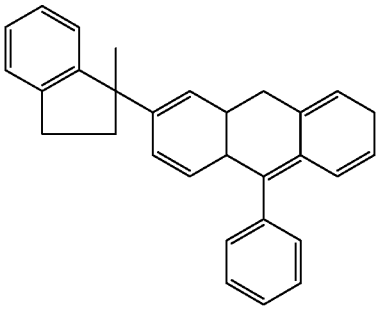

(59C)

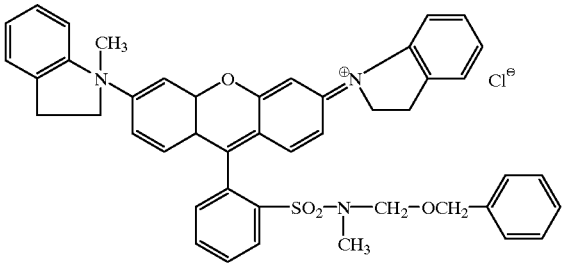

(60C)

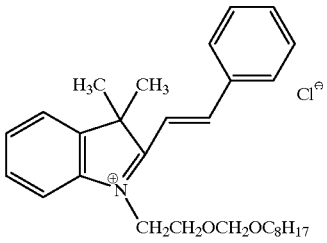

Cleavage of the acetal group in the present invention occurs by the action of heat alone, but the activation energy can be reduced sharply by the coexistence of an acid catalyst.

The acid used in the present invention (i.e., in the thermal recording medium and an image formation method described in 1) to 25) above) may be either Brϕnsted acids or Lewis acids. However, Brϕnsted acids are preferred, and phenol derivatives, sulfonic acid derivatives and carboxylic acid derivatives are particularly preferred. The activity and keeping quality can be adjusted by changing the pKa of the acids used, depending on their purpose. Although these acids may be low-molecular weight compounds, they are more preferably polymers for obtaining the compatibility of the sensitivity with the keeping quality and preventing the ablation. The molecular weight of the polymers preferably ranges from 1,000 to 1,000,000, and more preferably from 5,000 to 50,000. Preferred examples of the polymers include polyvinylphenol, polyvinylbenzenesulfonic acid, polyvinylbenzoic acid and derivatives thereof. Further, copolymers may be formed together with other monomers in order to provide physical properties corresponding to their purpose. Preferred examples of the monomers for forming the copolymers include acrylic esters, methacrylic esters, acrylamides, styrene and vinyl ethers.

Examples of the acids useful in the present invention are shown below, but the present invention is not limited thereto.

(A-1)

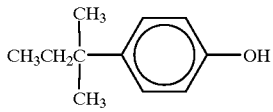

(A-2)

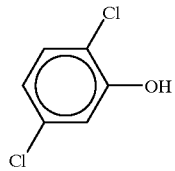

(A-3)

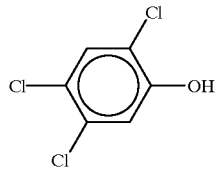

(A-4)

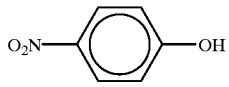

(A-5)

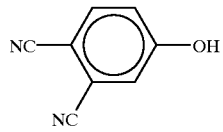

(A-6)

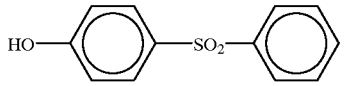

-continued
(A-7)
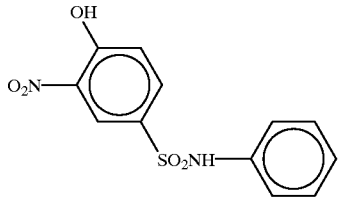
(A-8)
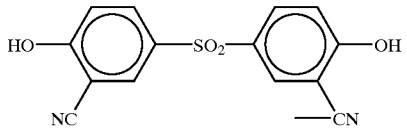
(A-9)
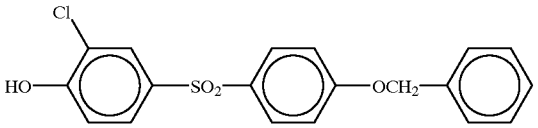
(A-10)
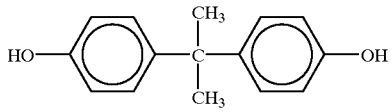
(A-11)
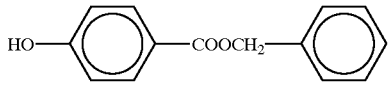
(A-12)
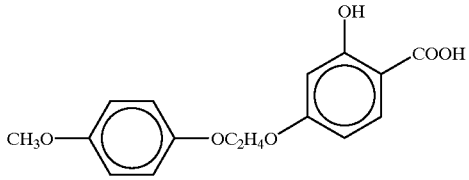
(A-13)
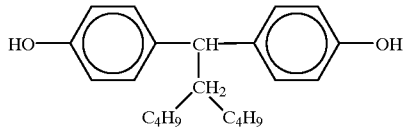
(A-14)
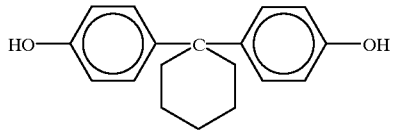
(A-15)
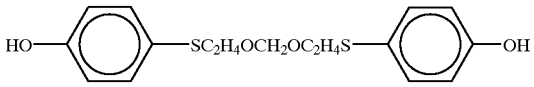
(A-16)
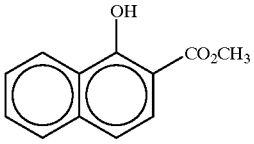
-continued
(A-17)
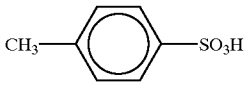
(A-18)
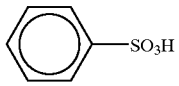
(A-19)
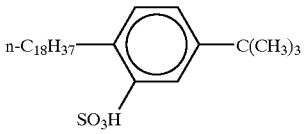
(A-20)
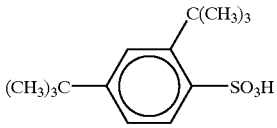
(A-21)
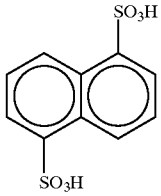
(A-22)
$CH_3(CH_2)_7SO_3H$
(A-23)
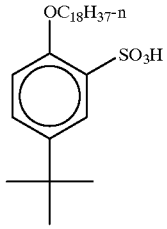
(A-24)
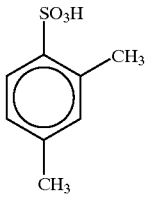
(A-25)
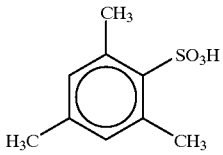

-continued
(A-26)
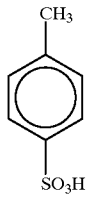
(A-27)
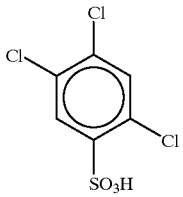
(A-28)
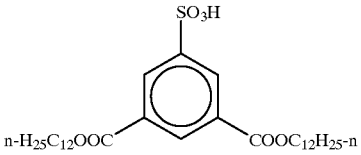
(A-29)
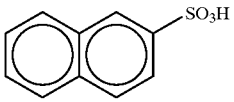
(A-30)
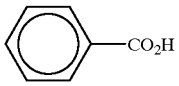
(A-31)
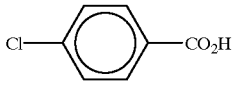
(A-32)
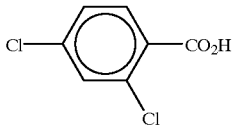
(A-33)
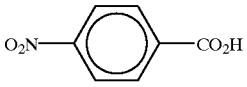
(A-34)
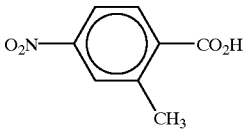
(A-35)
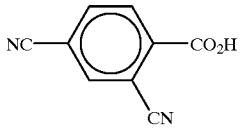
-continued
(A-36)
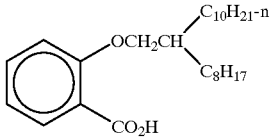
(A-37)
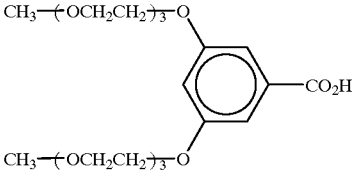
(A-38)
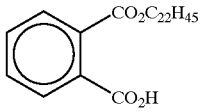
(A-39)
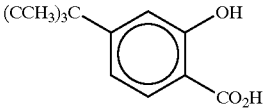
(A-40)
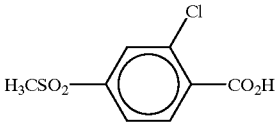
(A-41)
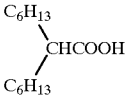
(A-42)
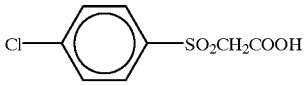
(A-43)
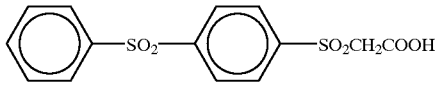
(A-44)
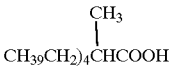
(A-45)
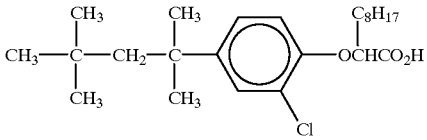
(A-46)
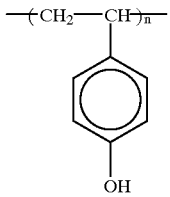

-continued
(A-47)
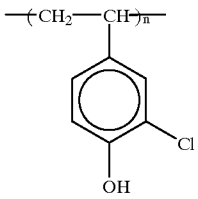
(A-48)
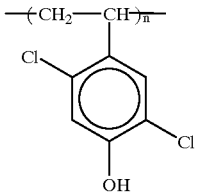
(A-49)
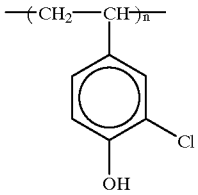
(A-50)
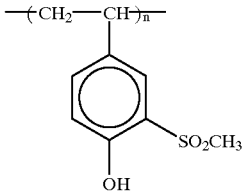
(A-51)
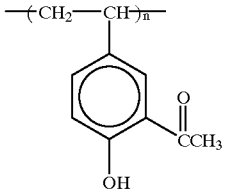
(A-52)
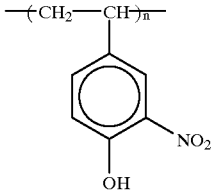
(A-53)
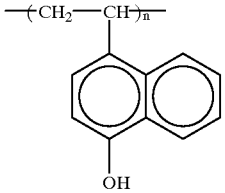
-continued
(A-54)
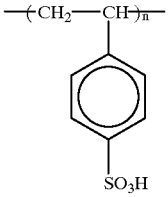
(A-55)
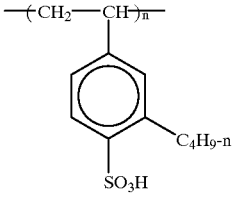
(A-56)
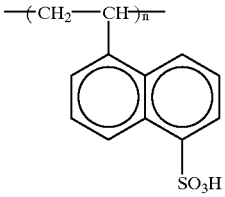
(A-57)
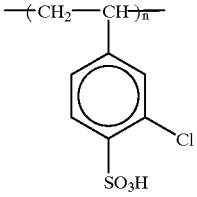
(A-58)
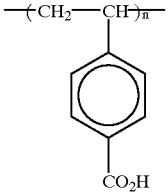
(A-59)
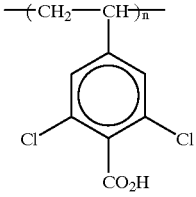
(A-60)
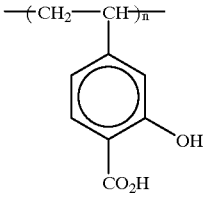

-continued (A-61)

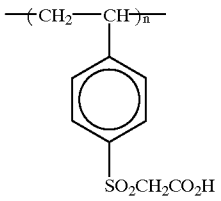

(A-62)

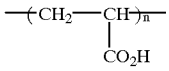

(A-63)

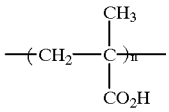

(A-64)

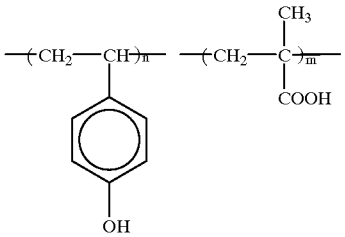

(A-65)

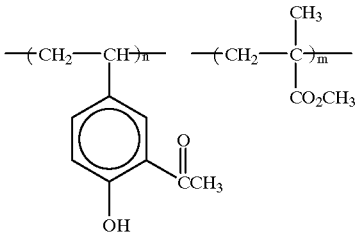

(A-66)

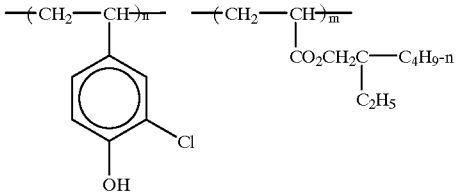

(A-67)

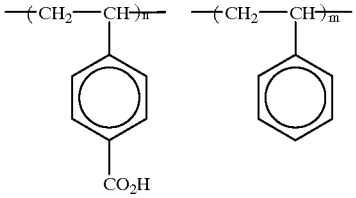

(A-68)

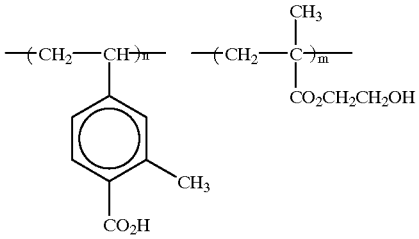

-continued (A-69)

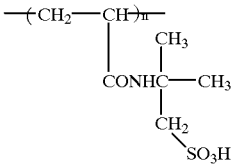

(A-70)

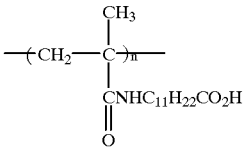

(A-71)

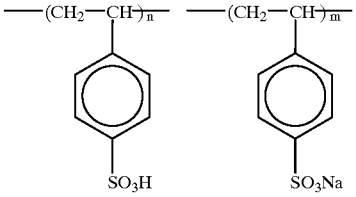

(A-72)

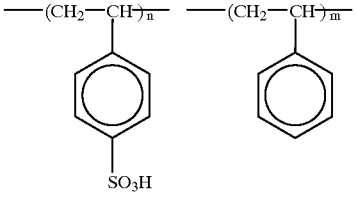

(A-73)

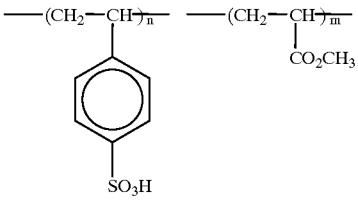

The thermal recording mediums of the present invention are generally prepared by coating supports with the ultraviolet absorber precursors represented by the above-mentioned formula (1-A) or the image forming comopounds causing hue change described above (e.g., image forming compounds used in 8) to 25) above) and the acids. In this case, binders may be allowed to coexist as needed. In addition, the ultraviolet absorber precursors represented by formula (1-A) or the image forming. compounds causing hue change and the acids can also be separated from each other by use of microcapsules, or can each be applied onto different layers adjacent to each other to enhance the keeping quality of the material. A variety of additives such as sensitizers and sticking inhibitors can also be used. Various known techniques in customary thermal recording mediums can also be used, including the formation of an overcoat layer for protecting a thermal recording layer, the formation of a backcoat layer on the back of a support, and the formation of an undercoat layer consisting of a single layer or plural layers of resin between a thermal recording layer and a support. Other known thermal color development systems (for example, a system of developing color using a basic leuco dye with an acid) can also be used in combination for providing desired color images corresponding to their purpose.

The binders which can be used include water-soluble binders such as gelatin, casein, starch derivatives, hydroxyethyl cellulose, carboxymethyl cellulose, polyvinyl alcohol, polyacrylamide and ethylene-maleic anhydride copolymers, and water-insoluble binders such as polyvinyl butyral, triacetyl cellulose, polystyrene, methyl acrylate-butadiene copolymers and acrylonitrile-butadiene copolymers.

When the ultraviolet absorber precursors represented by formula (1-A) or the image forming compounds causing hue change are allowed to be contained in microcapsules, known microencapsulation techniques can be used. That is to say, the ultraviolet absorber precursor represented by formula (1-A) or the image forming compounds causing hue change and a microcapsule wall precursor are dissolved in an organic solvent which is slightly soluble or insoluble in water, and the resulting solution is added to an aqueous solution of a water-soluble polymer, followed by emulsion dispersing with a homogenizer. Then, the temperature of the resulting dispersion is elevated to form a wall film of a polymer becoming microcapsule walls in an oil/water interface, thereby preparing microcapsules. Examples of the polymers becoming the microcapsule walls include polyurethane resins, polyurea resins, polyamide resins, polyester resins, polycarbonate resins, aminoaldehyde resins, melamine resins, polystyrene resins, styrene-acrylate copolymer resins, styrene-methacrylate copolymer resins, gelatin, polyvinyl alcohol and mixtures thereof. Of these, microcapsules having wall films formed of polyurethane-polyurea resins are particularly preferred. The microcapsules having the wall film formed of the polyurethane-polyurea resin are produced by mixing a microcapsule wall precursor such as a polyvalent isocyanate with a core substance to be encapsulated, dispersing the mixture by emulsification into an aqueous solution of a water-soluble polymer such as polyvinyl alcohol, and elevating the temperature of the resulting dispersion to causes a polymer formation reaction in an oil drop interface.

Examples of the polyvalent isocyanate compounds used as the microcapsule wall precursors include diisocyanates such as m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, and cyclohexylene-1,4-diisocyanate; triisocyanates such as 4,4',4"-triphenylmethanetriisocyanate and toluene-2,4,6-triisocyanate; tetraisocyanates such as 4,4'-dimethyldiphenylmethane-2,2',5,5'-tetraisocyanate; and isocyanate prepolymers such as an adduct of hexamethylenediisocyanate with trimethylolpropane, an adduct of 2,4-tolylenediisocyanate with trimethylolpropane, an adduct of xylylenediisocyanate with trimethylolpropane and tolylenediisocyanate with hexanetriol. It is also possible to use two or more kinds of them in combination as needed. Of these, compounds each containing three or more isocyanate groups in a molecule are particularly preferred.

In the microencapsulation, the organic solvents used for dissolving the ultraviolet absorber precursors represented by formula (1-A) or the image forming compounds causing hue change may be solid or liquid at ordinary temperature, and may be polymers. Examples thereof include low boiling auxiliary solvents such as acetic esters, methylene chloride and cyclohexanone: and high boiling oils such as phosphoric esters, phthalic esters, acrylic esters, methacrylic esters, other carboxylic esters, fatty acid amides, alkylated biphenyls, alkylated terphenyls, alkylated naphthalenes, diarylethanes, chlorinated paraffin, alcohols, phenols, ethers, monoolefins and epoxy-based oils. Of these, alcohols, phosphoric esters, carboxylic esters, alkylated biphenyls, alkylated terphenyls, alkylated naphthalenes and diarylethanes are particularly preferred. Antioxidants such as hindered phenols and hindered amines may be added to the above-mentioned high boiling oils. As the oils, oils containing unsaturated fatty acids are particularly preferred, and specific examples thereof include an α-methylstyrene dimer.

The water-soluble polymers used in the microencapsulation include polyvinyl alcohol, silanol-modified polyvinyl alcohol, carboxy-modified polyvinyl alcohol, amino-modified polyvinyl alcohol, itaconic acid-modified polyvinyl alcohol, styrene-modified polyvinyl alcohol, styrene-maleic anhydride copolymers, butadiene-maleic anhydride copolymers, ethylene-maleic anhydride copolymers, polyacrylamide, polystyrene-sulfonic acid polyvinyl pyrrolidone, ethylene-acrylic acid copolymers and gelatin. Of these, carboxy-modified polyvinyl alcohol is particularly preferred. Emulsions or latexes of hydrophobic-polymers can be used in combination with the water-soluble polymers. Specific examples thereof include styrene-butadiene copolymers, carboxy-modified styrene-butadiene copolymers and acrylonitrile-butadiene copolymers. In this case, known surfactants may be added as needed for improving the emulsion stability.

The particle size of the microcapsules in the UV absorber precursors is preferably from 0.1 μm to 1.0 μm, and more preferably from 0.2 μm to 0.7 μm.

The particle size of the microcapsules in the image forming compounds causing hue change is preferably from 0.1 μm to 5.0 μm, and more preferably from 0.1 μm to 1.0 μm.

As the sensitizers added to increase the heat sensitivity of the thermal recording materials, low melting organic compounds appropriately containing aromatic groups and polar groups are preferably used. Examples thereof include benzyl p-benzyloxybenzoate, α-naphthyl benzyl ether, β-naphthyl benzyl ether, phenyl β-naphthoate, phenyl α-hydroxy-β-naphthoate, β-naphthol-(p-chlorobenzyl) ether, 1,4-butanediol phenyl ether, 1,4-butanediol-p-methylphenyl ether, 1,4-butanediol-p-ethylphenyl ether, 1,4-butanediol-m-mehylphenyl ether, 1-phenoxy-2-(p-tolyloxy)ethane, 1-phenoxy-2-(p-ethylphenoxy)ethane, 1-phenoxy-2-(p-chlorophenoxy)ethane and p-benzylbiphenyl.

The other additives include head wear and sticking inhibitors composed of metal salts of higher fatty acids such as lead stearate and calcium stear-ate; and waxes such as paraffin, paraffin oxide, polyethylene, polyethylene oxide and caster wax. They can be added as needed.

The supports useful for the image recording mediums of the present invention include transparent supports of glass or polymer films such as polyethylene, polypropylene, polyethylene terephthalate, polyethylene 2,6-naphthylenedicarboxylate, polyallylenes, polyimides, polycarbonates and triacetyl cellulose.

When the image recording mediums of the present invention are used for platemaking films, supports low in the coefficient of thermal expansion, good in dimensional stability and having no absorption in the light-sensitive region of presensitized plates are selected.

In the image recording mediums of the present invention, heating methods as means for forming images include a method of bringing the mediums into contact with a heated block or plate, a method of bringing the mediums into contact with a heated roller or drum, a method of irradiating the mediums with a halogen, infrared or far infrared lamp heater, a method of heating the mediums in image form with a thermal head of a thermal printer, and a method of irradiating the mediums with a laser beam. In order to form images with less heat energy, the image recording mediums of the present invention can be preheated at an appropriate temperature, which is particularly effective when the ultraviolet absorber precursors represented by formula (1-A) or the image forming compounds causing hue change and the acids are separated from each other by use of microcapsules, or by application thereof onto different layers. The preheating temperature is preferably from 50° C. to 120° C., and particularly preferably from 70° C. to 100° C.

When images are formed by irradiation with a laser beam, it is necessary to allow a dye absorbing light having the same wavelength as that of the laser beam to exist for converting the laser beam into heat energy. Although laser beam sources include excimer lasers, argon lasers, helium neon lasers, semiconductor lasers, glass (YAG) lasers, carbon dioxide gas lasers and dye lasers, laser sources useful in the present invention are helium neon lasers, semiconductor lasers and glass lasers. of these, semiconductor lasers are particularly useful because of their small and inexpensive devices. The oscillation wavelength of the semiconductor laser beam is normally from 670 nm to 830 nm, and a dye having absorption in the near infrared region is used. Cyanine dyes, squarylium dyes, merocyanine dyes, oxonol dyes and phthalocyanine dyes are used as the near infrared absorption dyes.

The present invention will be further illustrated in greater detail with reference to the following examples, which are, however, not to be construed as limiting the invention.

Synthetic Example 1 of UV Absorber Precursor: Exemplified Compound (1)

2-(2H-benzotriazole-2-yl)-4-(1,1,3,3-tetramethylbutyl) phenol (5 g) was dissolved in tetrahydrofuran (30 ml), and potassium t-butoxide (1.73 g) was added thereto. Into the reaction solution cooled with ice, a solution where ditert-butylester dicarbonate (4.04 g) was dissolved in tetrahydrofuran (30 ml) was added, followed by stirring for one hour. The resulting reaction solution was added to water (100 ml). The organic layer was extracted with ethyl acetate (100 ml), followed by water washing. The organic layer was subjected to drying with magnesium sulfate to concentrate. The obtained crude crystals were subjected to recrystallization with acetonitrile to obtain transparent crystals (4.78 g) of Exemplified Compound (1).

Synthetic Example 1 of UV Absorber Precursor: Exemplified Compound (44)

2-(2H-benzotriazole-2-yl)-4-(1,1,3,3-tetramethylbutyl) phenol (5 g) was dissolved in ethyl acetate (30 ml), and DBU (2.82 g) was added thereto. Into the reaction solution cooled with ice, t-butylmethylsiliychloride (2.8 g) was added, followed by stirring for one hour. The resulting reaction solution was added to water (100 ml). The organic layer was extracted, followed by water washing. The organic layer was subjected to drying with magnesium sulfate to concentrate. The obtained oily substance was generated by silica gel column chromatography (developing solvent: n-hexane) to obtain the oily substance (6.3 g) of Exemplified Compound (44).

The other UV absorber precursor can be synthesized in the same manner as in the above Synthetic Examples 1 and 2.

EXAMPLE 1

Samples 1 and 2 shown below were each dissolved in chloroform, and applied onto 100-$\mu$m thick polyethylene terephthalate films, followed by drying. A silicone liquid (Shin-Silicone FL-100 manufactured by Shin-Etsu Chemical Co., Ltd.) was further applied thereon in a thickness of 0.1 $\mu$m to prepare transparent thermal recording sheets.

| Sample 1 | |
|---|---|
| Polystyrene (Polystyrene Beads Manufactured by Wako Pure Chemical Industries, Ltd. (size: about 3.2 mm)) | 0.85 g/m$^2$ |
| Ultraviolet Absorber Precursor (1) | 2 mmol/m$^2$ |
| Acid (A-17) | 20 mmol/m$^2$ |
| **Sample 2** | |
| Ultraviolet Absorber Precursor (1) | 2 mmol/m$^2$ |
| Acid (A-50) | 0.85 g/m$^2$ |

Image recording on the above-mentioned thermal recording materials with a Fuji Thermal Imager, Model FTI-210 provided positive images corresponding to $\lambda$=365 nm. The maximum density of image areas and the minimum density of non-image areas were measured, and results thereof are shown in Table 1.

TABLE 1

| Sample | Maximum Density (Dmax) | Minimum Density (Dmin) |
|---|---|---|
| Sample 1 | 2.73 | 0.07 |
| Sample 2 | 2.54 | 0.03 |

Table 1 shows that the thermal recording materials of the present invention are high in heat sensitivity and can provide positive images with high contrast by the use of a customary thermal imager.

EXAMPLE 2

Samples 3 to 10 and Reference Samples 1 and 2 shown below were each dissolved in chloroform, and applied onto 100-$\mu$m thick polyethylene terephthalate films, followed by drying to prepare transparent thermal recording sheets. As polyvinyl butyral, Butvar TMB76 manufactured by Monsanto Co.

| Sample 3 | |
|---|---|
| Polyvinyl Butyral | 0.85 g/m$^2$ |
| Ultraviolet Absorber Precursor (1) | 2 mmol/m$^2$ |
| Acid (A-3) | 40 mmol/m$^2$ |
| IR Dye-1 | 0.13 mg/m$^2$ |
| **Sample 4** | |
| Polyvinyl Butyral | 0.85 g/m$^2$ |
| Ultraviolet Absorber Precursor (1) | 2 mmol/m$^2$ |
| Acid (A-17) | 20 mmol/m$^2$ |
| IR Dye-1 | 0.13 mg/m$^2$ |
| **Sample 5** | |
| Polyvinyl Butyral | 0.85 g/m$^2$ |
| Ultraviolet Absorber Precursor (1) | 2 mmol/m$^2$ |

-continued

| | |
|---|---|
| Acid (A-40) | 40 mmol/m$^2$ |
| IR Dye-1 | 0.13 mg/m$^2$ |

Sample 6

| | |
|---|---|
| Acid (A-46) | 0.85 g/m$^2$ |
| Ultraviolet Absorber Precursor (1) | 2 mmol/m$^2$ |
| IR Dye-2 | 0.13 mg/m$^2$ |

Sample 7

| | |
|---|---|
| Acid (A-48) | 0.85 g/m$^2$ |
| Ultraviolet Absorber Precursor (2) | 2 mmol/m$^2$ |
| IR Dye-2 | 0.13 mg/m$^2$ |

Sample 8

| | |
|---|---|
| Acid (A-73) | 0.85 g/m$^2$ |
| Ultraviolet Absorber Precursor (3) | 2 mmol/m$^2$ |
| IR Dye-2 | 0.13 mg/m$^2$ |

Sample 9

| | |
|---|---|
| Acid (A-47) | 0.85 g/m$^2$ |
| Ultraviolet Absorber Precursor (16) | 2 mmol/m$^2$ |
| IR Dye-2 | 0.13 mg/m$^2$ |

-continued

Sample 10

| | |
|---|---|
| Acid (A-3) | 20 mmol/m$^2$ |
| Ultraviolet Absorber Precursor (36) | 2 mmol/m$^2$ |
| IR Dye-3 | 0.13 mg/m$^2$ |

Reference Sample 1

| | |
|---|---|
| Nitrocellulose (Manufactured by Daicel Chemical Industries, Ltd., viscosity: 1000 sec) | 0.85 g/m$^2$ |
| Reference Dye-1 | 0.35 g/m$^2$ |
| Reference Dye-2 | 0.55 g/m$^2$ |
| IR Dye-1 | 0.13 mg/m$^2$ |

Reference Sample 2

| | |
|---|---|
| Polyvinyl Butyral | 0.85 g/m$^2$ |
| Reference Dye-1 | 0.35 g/m$^2$ |
| Reference Dye-2 | 0.55 g/m$^2$ |
| IR Dye-1 | 0.13 mg/m$^2$ |

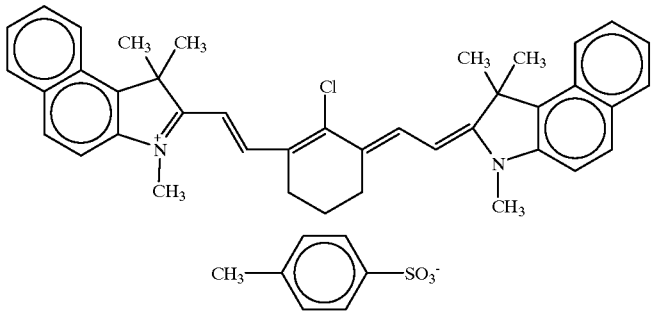

IR Dye-1

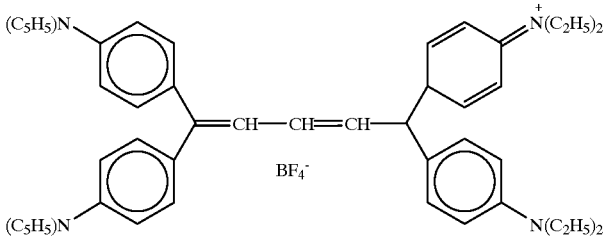

IR Dye-2

-continued

IR Dye-3

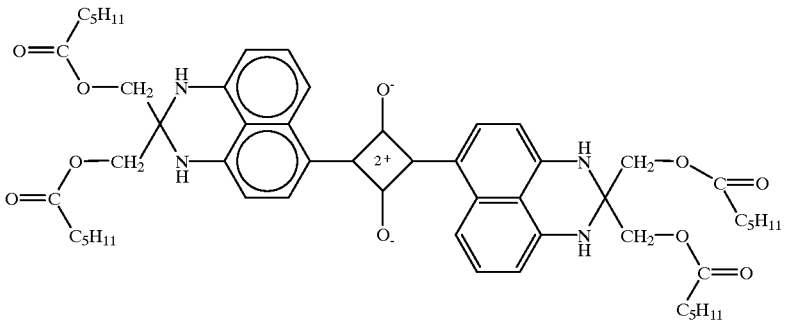

Reference Dye-1

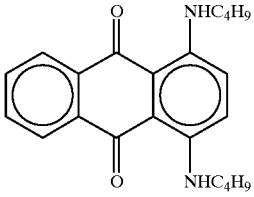

Reference Dye-2

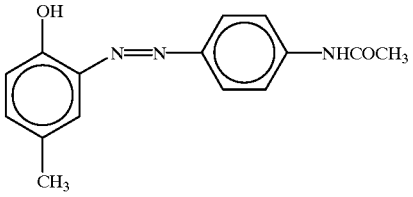

<Exposure Conditions for Image Formation>

Eight beams of Spectra Diode Labs No. SDL-2430 (wavelength region: 800 nm to 830 nm) were joined together to obtain an output of 800 mW, and used as an image write laser.

Using this laser, each of the samples described above was exposed so as to form an image of 22 mm×9 mm under conditions set as follows: 160 $\mu$m beam system, 0.5 m/second laser scanning speed (at the middle portion of scanning), 15 mm/second sample conveying speed and 8 lines/mm scanning pitch. At this time, the laser energy density on the samples was 10 mJ/mm$^2$. The energy density was varied as shown in Table 2 by changing the laser scanning speed and the laser output.

<Comparison of Image Formation Efficiency at the Middle Portion of Laser Scanning (Image Area)>

As to Samples 3 to 10 of the present invention, the ultraviolet density (365 nm) at the middle portion of laser scanning (image area) was determined with a MacBeth densitometer, and the image formation efficiency (color development efficiency) was calculated by comparison with a theoretical value in 100% color development. For Reference Samples 1 and 2, the image formation efficiency (decoloration efficiency) was calculated by comparison of the ultraviolet density (365 nm) at the middle portion of the laser scanning (image area) with that of the non-image area.

Results thereof are shown in Table 2.

TABLE 2

| | Image Formation Efficiency (%) | | |
|---|---|---|---|
| | Laser Energy Density 10 mJ/mm$^2$ | Laser Energy Density 5 mJ/mm$^2$ | Laser Energy Density 3 mJ/mm$^2$ |
| Sample 3 (Invention) | 76.7 | 84.3 | 74.0 |
| Sample 4 (Invention) | 87.8 | 96.7 | 92.4 |
| Sample 5 (Invention) | 58.6 | 62.7 | 54.3 |
| Sample 6 (Invention) | 74.8 | 85.2 | 80.1 |
| Sample 7 (Invention) | 86.1 | 93.5 | 82.3 |
| Sample 8 (Invention) | 90.2 | 98.7 | 94.8 |
| Sample 9 (Invention) | 79.0 | 85.4 | 76.3 |

TABLE 2-continued

| | Image Formation Efficiency (%) | | |
|---|---|---|---|
| | Laser Energy Density 10 mJ/mm$^2$ | Laser Energy Density 5 mJ/mm$^2$ | Laser Energy Density 3 mJ/mm$^2$ |
| Sample 10 (Invention) | 83.8 | 93.5 | 87.3 |
| Reference Sample 1 | 70.0 | 35.0 | 0 |
| Reference Sample 2 | 25.0 | 0 | 0 |

When the laser energy density was 10 mJ/mm$^2$, it was confirmed by observation of the exposed areas under an optical microscope that ablation took place at the middle portion of laser scanning in all the samples. In the color development type samples of the present invention, therefore, the apparent color development efficiency looks like lower than the actual efficiency. On the other hand, when the laser energy density was 5 mJ/mm$^2$ or less, no ablation was observed except Reference Sample-1. Table 2 indicates that the samples of the present invention in which the dyes absorbing the wavelength of the laser beam are used can efficiently form images even at such a low energy (5 mJ/mm$^2$ or less) that no ablation takes place, and are more excellent than the samples in which ablation with laser beams is utilized.

EXAMPLE 3

Transparent thermal recording sheets as shown below were prepared. Parts indicating the amount added are by weight.

Sample 11

Four parts of ultraviolet absorber precursor (1) and 1 part of IR dye-1 were mixed with and completely dissolved in 6.6 parts of ethyl acetate and 6.6 parts of dioctyl phthalate. Two parts of xylylenediisocyanate/trimethylol-propane (a 75% solution in ethyl acetate: Takenate D110N (trade name); manufactured by Takeda Chemical Industries, Ltd.) was added to this solution as a capsule wall agent, and stirred so as to form an uniform solution. On the other hand, 60 parts of a 10 wt% aqueous solution of carboxyl-modified polyvinyl alcohol (PVA217E (trade name); manufactured by Kuraray Co., Ltd.) containing 3.2 parts of a 10 wt % aqueous solution of sodium dodecylsulfonate was prepared, and the above-mentioned solution was added thereto, followed by dispersing by emulsification with a homogenizer. The temperature of the emulsion thus obtained was elevated to 50° C. with stirring to conduct the encapsulation reaction for 3 hours, thus obtaining a capsule solution which contains ultraviolet absorber precursor (1) and IR dye-1 as core substances. The average particle size of the capsules was 0.2 μm.

Then, 20 parts of acid (A-8) was added to 100 parts of a 5% aqueous solution of polyvinyl alcohol and dispersed for about 24 hours in a sand mill to obtain a dispersion of acid (A-8).

Three parts of the dispersion of acid (A-8) was added to 2 parts of the capsule solution obtained above to prepare a coating solution.

This coating solution was applied onto a 100-μm thick polyethylene terephthalate film so that the amount of ultraviolet absorber precursor (1) became 2 mmol/m$^2$, and dried at 40° C. for 1 hour to prepare a thermal recording sheet.

Sample 12

Twenty-seven parts of ultraviolet absorber precursor (1) and 3.6 parts of IR dye-1 were dissolved in 30 parts of polyvinyl butyral and 100 parts of chloroform, and the resulting solution was applied onto a 100-μm thick polyethylene terephthalate film so that the amount of ultraviolet absorber precursor (1) became 2 mmol/m$^2$, and then dried. The coated film after drying had a thickness of 3.8 μm. A solution of 5 parts of acid (A-73) in 95 parts of methanol was further applied thereto so as to give a thickness of 2 μm after drying, followed by drying to prepare a transparent thermal recording sheet.

<Exposure Conditions for Image Formation>

Image recording was performed on Samples 11 and 12 with preheating at 100° C., at a laser energy density of 5 mJ/mm$^2$ under the laser exposure conditions described in Example 2. In addition, laser exposure was also conducted on the above-mentioned samples under the same conditions as described above with the exception that they were not preheated.

<Evaluation of Color Densities in Image and Non-image Areas>

The ultraviolet densities (365 nm) of the middle portions of laser scanning (image areas) and non-image areas were measured with a MacBeth densitometer. In addition, after they were stored at 50° C. for 3 days, image recording was similarly conducted thereon, and the ultraviolet densities of image areas and non-image areas were measured.

Results thereof are shown in Table 3.

TABLE 3

| | Preheated | | Not Preheated | |
|---|---|---|---|---|
| | Maximum Density (Dmax) | Minimum Density (Dmin) | Maximum Density (Dmax) | Minimum Density (Dmin) |
| Sample 13 (Raw) | 2.37 | 0.32 | 0.89 | 0.33 |
| Sample 13 (Aged) | 2.43 | 0.35 | 0.93 | 0.36 |
| Sample 14 (Raw) | 2.88 | 0.38 | 1.23 | 0.37 |
| Sample 14 (Aged) | 2.84 | 0.42 | 1.41 | 0.39 |

Table 3 indicates that the samples 11 and 12 provide positive images with high contrast by laser exposure with preheating at 100° C., and that the thermal recording materials of the present invention have excellent keeping quality.

The thermal recording materials of the present invention have high thermal sensitivity, are recordable (particularly, image recording corresponding to 360 nm to 420 nm which is indispensable to a platemaking mask film) with such a low output laser that no ablation takes place even when a thermal heat mode image recording system using a laser is utilized, and require no different receiving sheet. Further, the thermal recording materials of the present invention are excellent in keeping quality.

EXAMPLE 4

The compounds shown in the following were dissolved in chloroform, and the solution was coated on a polyethylene terephthalate film to a thickness of 100 μm and then dried. Thereafter, a silicone solution (Shin-Etsu Silicone FL-100, manufactured by Shin-Etsu Chemical) was further coated thereon to a thickness of 0.1 μm, thereby obtaining a transparent image recording sheet.

| Sample-1B | |
|---|---|
| Polystyrene (Polystyrene Beads mfd. by Wako Pure Chemical Industries (diameter; about 3.2 mm)) | 0.85 g/m$^2$ |
| LD-(1) | 2 mmol/m$^2$ |
| IR pigment | 0.13 mg/m$^2$ |

| Sample-2B | |
|---|---|
| Polystyrene (Polystyrene Beads mfd. by Wako Pure Chemical Industries (diameter; about 3.2 mm)) | 0.85 g/m$^2$ |
| LD-(10) | 2 mmol/m$^2$ |
| IR pigment | 0.13 mg/m$^2$ |

| Sample-3B | |
|---|---|
| Polystyrene (Polystyrene Beads mfd. by Wako Pure Chemical Industries (diameter; about 3.2 mm)) | 0.85 g/m$^2$ |
| LD-(11) | 2 mmol/m$^2$ |
| IR pigirient | 0.13 mg/m$^2$ |

| Sample-4B | |
|---|---|
| Polystyrene (Polystyrene Beads mfd. by Wako Pure Chemical Industries (diameter; about 3.2 mm)) | 0.85 g/m$^2$ |
| LD-(1) | 2 mmol/m$^2$ |
| Acid (A-17) | 2 mmol/m$^2$ |
| IR pigment-1 | 0.13 mg/m$^2$ |

| Sample-5B | |
|---|---|
| Polystyrene (Polystyrene Beads mfd. by Wako Pure Chemical Industries (diameter; about 3.2 mm)) | 0.85 g/m$^2$ |
| LD-(1) | 2 mmol/m$^2$ |
| Acid (A-3) | 4 mmol/m$^2$ |
| IR pigment | 0.13 mg/m$^2$ |

| Sample-6B | |
|---|---|
| Acid (A-48) | 0.85 g/m$^2$ |
| LD-(1) | 2 mmol/m$^2$ |
| IR pigment | 0.13 mg/m$^2$ |

| Sample-7B | |
|---|---|
| Acid (A-50) | 0.85 g/m$^2$ |
| LD-(1) | 2 mmol/m$^2$ |
| IR pigment | 0.13 mg/m$^2$ |

| Sample-8B | |
|---|---|
| Polystyrene (Polystyrene Beads mfd. by Wako Pure Chemical Industries (diameter; about 3.2 mm)) | 0.85 g/m$^2$ |

-continued

| | |
|---|---|
| LD-(38) | 2 mmol/m$^2$ |
| IR pigment | 0.13 mg/m$^2$ |

Sample-9B

| | |
|---|---|
| Polystyrene (Polystyrene Beads mfd. by Wako Pure Chemical Industries (diameter; about 3.2 mm)) | 0.85 g/m$^2$ |
| LD-(34) | 2 mmol/m$^2$ |
| IR pigment | 0.13 mg/m$^2$ |

Sample-10B

| | |
|---|---|
| Polystyrene (Polystyrene Beads mfd. by Wako Pure Chemical Industries (diameter; about 3.2 mm)) | 0.85 g/m$^2$ |
| LD-(19) | 2 mmol/m$^2$ |
| IR pigment | 0.13 mg/m$^2$ |

Reference Sample-1B

| | |
|---|---|
| Polystyrene (Polystyrene Beads mfd. by Wako Pure Chemical Industries (diameter; about 3.2 mm)) | 0.85 g/m$^2$ |
| Comparative Compound (1) | 2 mmol/m$^2$ |
| IR pigment | 0.13 mg/m$^2$ |

Reference Sample-2B

| | |
|---|---|
| Polystyrene (Polystyrene Beads mfd. by Wako Pure Chemical Industries (diameter; about 3.2 mm)) | 0.85 g/m$^2$ |
| Comparative Compound (2) | 2 mmol/m$^2$ |
| IR pigment | 0.13 mg/m$^2$ |

Reference Sample-3B

| | |
|---|---|
| Polystyrene (Polystyrene Beads mfd. by Wako Pure Chemical Industries (diameter; about 3.2 mm)) | 0.85 g/m$^2$ |
| Comparative Compound (3) | 2 mmol/m$^2$ |
| IR pigment | 0.13 mg/m$^2$ |

Reference Sample-4B

| | |
|---|---|
| Polystyrene (Polystyrene Beads mfd. by Wako Pure Chemical Industries (diameter; about 3.2 mm)) | 0.85 g/m$^2$ |
| Comparative Compound (4) | 2 mmol/m$^2$ |
| IR pigment | 0.13 mg/m$^2$ |

Comparative Compound-(1)

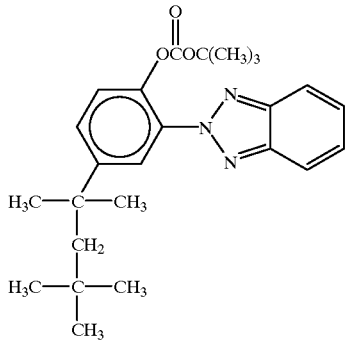

Comparative Compound-(2)

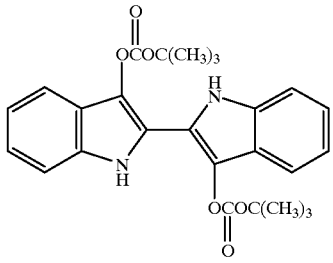

Compound described in Example I of JP-A-124175

Comparative Compound-(3)

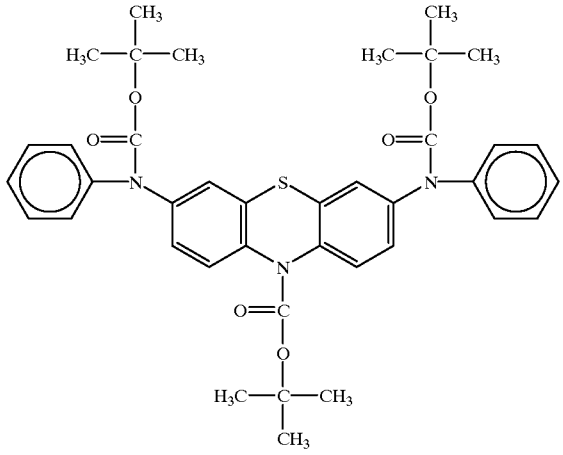

Compound described in Example 24 of U.S. Pat. No. 4,826,976

Comparative Compound-(4)

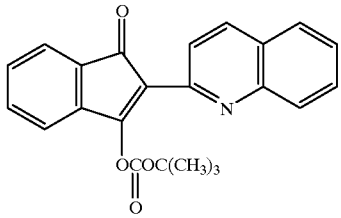

Compound described in Example 1 of U.S. Pat. No. 5,243,052 IR pigment

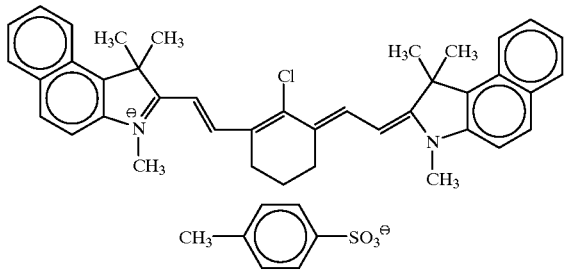

<Exposure Conditions for Image Formation>

A total of 8 Spectra Diode Labs No. SDL-2430 (wave length range: 800–830 nm) were combined and adjusted to an output of 800 mW to be used as image writing laser.

Using the thus prepared laser, exposure was carried out upon each of the aforementioned samples to obtain an image of 22 mm×9 mm, with a beam system of 160 $\mu$m, at a laser scanning speed of 0.5 m/sec (scanning center area), at a sample feeding speed of 15 mm/sec and at a scanning pitch of 8/mm. In this case, laser energy density on the sample was 10 mJ/mm$^2$. Also, the energy density was changed as shown in Table 4 by changing the laser scanning speed and laser output.

<Comparison of Image Formation Efficiency on Laser Scanning Center Area (image area)>

Absorption of micro-spots on the laser exposure area was measured for each sample. Also, by postulating complete color development of each sample, membranes on which theoretical amount of pigment was coated were prepared to calculate image formation efficiency from the comparison with the absorbance.

The results are shown in Table 4.

TABLE 4

| | Image formation efficiency (%) | | |
|---|---|---|---|
| | Laser energy density 10 mJ/mm$^2$ | Laser energy density 5 mJ/mm$^2$ | Laser energy density 3 mJ/mm$^2$ |
| Sample 1B (Inventive) | 88.4 | 76.8 | 36.5 |
| Sample 2B (Inventive) | 96.4 | 93.6 | 68.7 |
| Sample 3B (Inventive) | 100 | 98.0 | 72.3 |
| Sample 4B (Inventive) | 100 | 98.3 | 96.2 |
| Sample 5B (Inventive) | 93.8 | 85.4 | 52.7 |
| Sample 6B (Inventive) | 94.3 | 91.9 | 83.5 |
| Sample 7B (Inventive) | 96.5 | 93.0 | 64.8 |
| Sample 8B (Inventive) | 91.2 | 68.3 | 23.8 |
| Sample 9B (Inventive) | 86.5 | 48.3 | 15.6 |
| Sample 10B (Inventive) | 100 | 100 | 89.2 |
| Reference Sample 1B | 32.8 | 6.5 | 0 |
| Reference Sample 2B | 67.2 | 10.2 | 0 |
| Reference Sample 3B | 42.3 | 8.3 | 0 |
| Reference Sample 4B | 92.3 | 68.2 | 32.4 |

It is evident that the samples of the present invention 1B to 3B, 8B, 9B and 10B have high sensitivity in comparison with the respective reference samples 1B to 4B.

It is evident also that the inventive samples 4B to 7B to which an acid was added have high sensitivity in comparison with the inventive sample 1B.

In addition, it is evident that the sample 6B in which the image forming compound was dispersed by polymerizing an acid has high sensitivity in comparison with the sample 5B in which the image forming compound and a low molecular weight acid were dispersed using a polystyrene binder.

EXAMPLE 5

Transparent heat sensitive recording sheets shown below were prepared. In this case, the term "part" means "part by weight".

Sample 11B

Four parts of LD-(1) and 1 part of IR pigment were mixed with 6.8 parts of ethyl acetate and 6.6 parts of dioctyl phthalate and thoroughly dissolved. As a capsule wall agent, 2.0 parts of xylylene diisocyanate/trimethylolpropane (75% ethyl acetate solution: Takenate D110N (trade name), manufactured by Takeda Chemical Industries) was added to the thus prepared solution and stirred until the mixture became uniform. Separately from this, 60 parts of 10% by weight carboxy-modified polyvinyl alcohol (PVA 217E (trade name), manufactured by KURARAY) aqueous solution to which 3.2 parts of 10% by weight sodium dodecylsulfonate aqueous solution has been added was prepared, and this was mixed with the aforementioned solution and emulsification dispersion was carried out using a homogenizer. With stirring, the thus obtained emulsion was heated to 50° C. to carry out 3 hours of capsulation reaction, thereby obtaining a solution of capsules containing LD-(1) and IR pigment as core materials. Average particle size of the capsules was found to be 0.2 $\mu$m.

Next, 20 parts of acid (A-8) was added to 100 parts of 5% polyvinyl alcohol aqueous solution and dispersed for about 24 hours using a sand mill to obtain dispersion of the acid (A-8).

Three parts of the acid (A-8) dispersion was added to 2 parts of the above capsule solution and used as a coating solution.

The thus prepared coating solution was coated on a polyethylene terephthalate film having a thickness of 100 $\mu$m in such an amount that LD-(1) became 2 mmol/m$^2$ and then dried at 40° C. for 1 hour to obtain a heat sensitive recording sheet.

Sample 12B

A solution prepared by dissolving 27 parts of LD-(1), 3.6 parts of IR pigment and 30 parts of polyvinyl butyral in 100 parts of chloroform was coated on a polyethylene terephthalate film having a thickness of 100 $\mu$m in such an amount that LD-(1) became 2 mmol/m$^2$ and then dried. Membrane thickness of the coated material after drying was 3.8 $\mu$m. A solution prepared by dissolving 5 parts of the acid (A-73) in 95 parts of methanol was further coated thereon to a membrane thickness of 2 $\mu$m after drying and then dried to obtain a transparent heat sensitive recording sheet.

<Exposure Conditions for Image Formation>

The samples 11B and 12B were heated in advance at 100° C. and image recording was carried out at a laser energy density of 5 mJ/mm$^2$ by the laser exposure method described in Example 1. Also, as a comparative example, the aforementioned samples were subjected to the laser exposure under the same conditions but without the preliminary heating.

<Evaluation of Color Density on Image Area and Non-image Area>

The UV density (360 nm) on the laser scanning center area (image area) and non-image area was measured using a Macbeth density measuring instrument. Also, said recording material was stored at 50° C. for 3 days and then subjected to laser image recording to measure the UV density on the image area and non-image area.

The results are shown in Table 5.

TABLE 5

| | Preliminary heating | | No preliminary heating | |
|---|---|---|---|---|
| Sample | Maximum density (Dmax) | Minimum density (Dmin) | Maximum density (Dmax) | Minimum density (Dmin) |
| 11B* | 2.52 | 0.21 | 1.46 | 0.28 |
| 11B** | 2.48 | 0.23 | 1.52 | 0.24 |
| 12B* | 2.92 | 0.38 | 1.87 | 0.30 |
| 12B** | 2.94 | 0.42 | 1.79 | 0.39 |

*: raw sample
**: sample after storage

It is evident from the results shown in Table 5 that the samples 11B and 12B give positive images with high contrast when laser exposure is carried out with preliminary heating at 100° C. It is evident also that the heat sensitive recording material of the present invention has excellent shelf life.

Effects of the Invention

Since the image recording medium of the present invention has high heat sensitivity, images can be recorded by such a low output laser that abrasion is not generated, even when a laser-aided heat mode image recording method is used. Particularly, it is possible to carry out image recording corresponding to 360 nm to 420 nm essential for a mask film for plate making use. In addition, it does not require a special image receiving sheet and is excellent in storage stability.

Synthesis of Illustration Compound (1C)

A 3.23 g portion of the following compound (1a) was dissolved in tetrahydrofuran (30 ml) to which was then added 0.48 g of an oil dispersion of sodium hydride (60%), subsequently carrying out 30 minutes of stirring at room temperature. Next, this was mixed with 1.97 g of the compound (1b) and stirred at room temperature for 4 hours. Thereafter, ethyl acetate (60 ml) and water (50 ml) were added thereto and stirred, and then the water layer was separated. The organic layer was washed with brine and then concentrated under a reduced pressure. The resulting residue was purified by a silica gel column chromatography to obtain 3.75 g of the illustration compound (1C).

compound (1C)

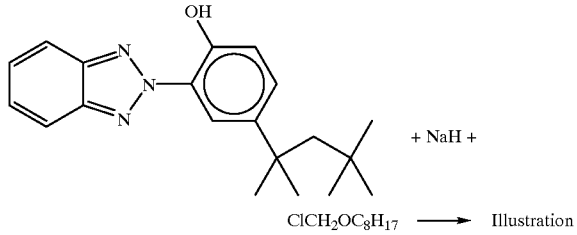

EXAMPLE 6

The compounds shown in the following were dissolved in chloroform, and the solution was coated on a polyethylene terephthalate film to a thickness of 100 μm and then dried. Thereafter, a silicone solution (Shin-Etsu Silicone FL-100, manufactured by Shin-Etsu Chemical) was further coated thereon to a thickness of 0.1 μm, thereby obtaining a transparent image recording sheet.

| Sample-1C | |
|---|---|
| Polystyrene (Polystyrene Beads mfd. by Wako Pure Chemical Industries (diameter; about 3.2 mm)) | 0.85 g/m$^2$ |
| Illustration compound (1C) | 2 mmol/m$^2$ |
| Acid (A-17) | 0.5 mmol/m$^2$ |
| IR pigment-1 | 0.13 mg/m$^2$ |

| Sample-2C | |
|---|---|
| Polystyrene (Polystyrene Beads mfd. by Wako Pure Chemical Industries (diameter; about 3.2 mm)) | 0.85 g/m$^2$ |
| Illustration compound (3C) | 2 mmol/m$^2$ |

-continued

| | |
|---|---|
| Acid (A-17) | 0.5 mmol/m$^2$ |
| IR pigment | 0.13 mg/m$^2$ |

| Sample-3C | |
|---|---|
| Polystyrene (Polystyrene Beads mfd. by Wako Pure Chemical Industries (diameter; about 3.2 mm)) | 0.85 g/m$^2$ |
| Illustration compound (1C) | 2 mmol/m$^2$ |
| Acid (A-3) | 4 mmol/m$^2$ |
| IR pigment | 0.13 mg/m$^2$ |

| Sample-4C | |
|---|---|
| Polystyrene (Polystyrene Beads mfd. by Wako Pure Chemical Industries (diameter; about 3.2 mm)) | 0.85 g/m$^2$ |
| Illustration compound (18C) | 2 mmol/m$^2$ |
| Acid (A-17) | 0.5 mmol/m$^2$ |
| IR pigment | 0.13 mg/m$^2$ |

| Sample-5C | |
|---|---|
| Polystyrene (Polystyrene Beads mfd. by Wako Pure Chemical Industries (diameter; about 3.2 mm)) | 0.85 g/m$^2$ |
| Illustration compound (49C) | 2 mmol/m$^2$ |
| Acid (A-17) | 0.5 mmol/m$^2$ |
| IR pigment | 0.13 mg/m$^2$ |

| Sample-6C | |
|---|---|
| Illustration compound (26C) | 2 mmol/m$^2$ |
| Acid (A-17) | 0.5 mmol/m$^2$ |
| IR pigment | 0.13 mg/m$^2$ |

| Reference Sample-1C | |
|---|---|
| Polystyrene (Polystyrene Beads mfd. by Wako Pure Chemical Industries (diameter; about 3.2 mm)) | 0.85 g/m$^2$ |
| Comparative Compound (1) | 2 mmol/m$^2$ |
| Acid (A-17) | 0.5 mmol/m$^2$ |
| IR pigment | 0.13 mg/m$^2$ |

| Reference Sample-2C | |
|---|---|
| Polystyrene (Polystyrene Beads mfd. by Wako Pure Chemical Industries (diameter; about 3.2 mm)) | 0.85 g/m$^2$ |
| Comparative Compound (2) | 2 mmol/m$^2$ |
| Acid (A-17) | 0.5 mmol/m$^2$ |
| IR pigment | 0.13 mg/m$^2$ |

Comparative Compound (1)

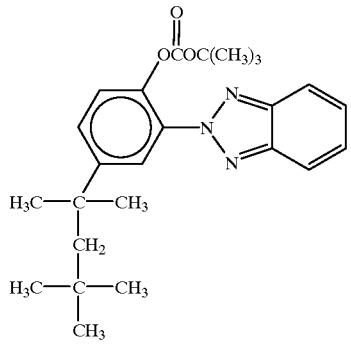

Comparative Compound (2)

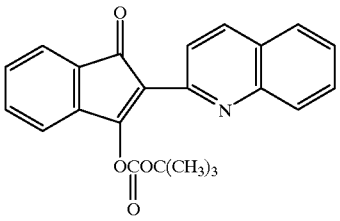

IR Pigment

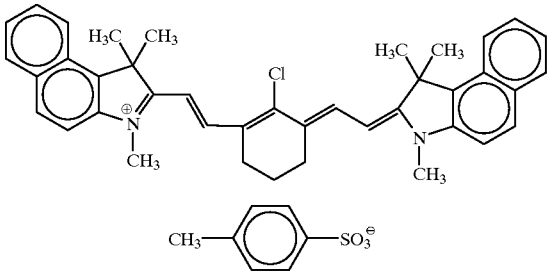

<Exposure Conditions for Image Formation>

A total of 8 Spectra Diode Labs No. SDL-2430 (wave length range: 800–830 nm) were combined and adjusted to an output of 800 mW to be used as image writing laser.

Using the thus prepared laser, exposure was carried out upon each of the aforementioned samples to obtain an image of 22 mm×9 mm, with a beam system of 160 $\mu$m, at a laser scanning speed of 0.5 m/sec (scanning center area), at a sample feeding speed of 15 mm/sec and at a scanning pitch of 8/mm. In this case, laser energy density on the sample was 10 mJ/mm$^2$. Also, the energy density was changed as shown in Table 6 by changing the laser scanning speed and laser output.

<Comparison of Image Formation Efficiency on Laser Scanning Center Area (image area)>

Absorption of micro-spots on the laser exposure area was measured for each sample. Also, by postulating complete color development of each sample, membranes on which theoretical amount of pigment was coated were prepared to calculate image formation efficiency from the comparison with the absorbance.

The results are shown in Table 6.

TABLE 6

| | Image formation efficiency (%) | |
|---|---|---|
| | Laser energy density 5 mJ/mm$^2$ | Laser energy density 3 mJ/mm$^2$ |
| Sample (1C) (inventive) | 98 | 72 |
| Sample (2C) (inventive) | 78 | 50 |
| Sample (3C) (inventive) | 65 | 35 |
| Sample (4C) (inventive) | 92 | 65 |
| Sample (5C) (inventive) | 93 | 69 |
| Sample (6C) (inventive) | 95 | 71 |

TABLE 6-continued

| | Image formation efficiency (%) | |
|---|---|---|
| | Laser energy density 5 mJ/mm$^2$ | Laser energy density 3 mJ/mm$^2$ |
| Comparative sample (1C) | 24 | 10 |
| Comparative sample (2C) | 32 | 8 |

Since the samples of the present invention have high sensitivity in comparison with the respective reference samples 1C and 2C, usefulness of the present invention is obvious.

EXAMPLE 7

Transparent heat sensitive recording sheets shown below were prepared. In this case, the term "part" means "part by weight".

Sample 7C

Four parts of the illustration compound (1C) and 1 part of IR pigment were mixed with 6.8 parts of ethyl acetate and 6.6 parts of dioctyl phthalate and thoroughly dissolved. As a capsule wall agent, 2.0 parts of xylylene diisocyanate/trimethylolpropane (75% ethyl acetate solution: Takenate D110N (trade name), manufactured by Takeda Chemical Industries) was added to the thus prepared solution and stirred until the mixture became uniform. Separately from this, 60 parts of 10% by weight carboxy-modified polyvinyl alcohol (PVA 217E (trade name), manufactured by KURARAY) aqueous solution to which 3.3 parts of 10% by weight sodium dodecylsulfonate aqueous solution has been added was prepared, and this was mixed with the aforementioned solution and emulsification dispersion was carried out using a homogenizer. With stirring, the thus obtained emulsion was heated to 50° C. to carry out 3 hours of capsulation reaction, thereby obtaining a solution of capsules containing the illustration compound (1C) and IR pigment as core materials. Average particle size of the capsules was found to be 0.2 $\mu$m.

Next, 20 parts of the acid (A-8) was added to 110 parts of 5% polyvinyl alcohol aqueous solution and dispersed for about 24 hours using a sand mill to obtain dispersion of the acid (A-8).

Three parts of the acid (A-8) dispersion was added to 2 parts of the above capsule solution and used as a coating solution.

The thus prepared coating solution was coated on a polyethylene terephthalate film having a thickness of 100 $\mu$m in such an amount that the illustration compound (1C) became 2 mmol/m$^2$ and then dried at 40° C. for 1 hour to obtain a heat sensitive recording sheet.

Sample 8C

A solution prepared by dissolving 27 parts of the illustration compound (1C), 3.6 parts of IR pigment and 30 parts of polyvinyl butyral in 100 parts of chloroform was coated on a polyethylene terephthalate film having a thickness of 100 $\mu$m in such an amount that the illustration compound (1C) became 2 mmol/m$^2$ and then dried. Membrane thickness of the coated material after drying was 3.8 $\mu$m. A solution prepared by dissolving 5 parts of the acid (A-73) in 95 parts of methanol was further coated thereon to a membrane thickness of 2 $\mu$m after drying and then dried to obtain a transparent heat sensitive recording sheet.

<Exposure Conditions for Image Formation>

The samples 7C and 8C were heated in advance at 100° C. and image recording was carried out at a laser energy density of 5 mJ/mm$^2$ by the laser exposure method described in Example 1. Also, as a comparative example, the aforementioned samples were subjected to the laser exposure under the same conditions but without the preliminary heating.

<Evaluation of Color Density on Image Area and Non-image Area>

The UV density (360 nm) on the laser scanning center area (image area) and non-image area was measured using a Macbeth density measuring instrument.

The results are shown in Table 7.

TABLE 7

| | Maximum density (Dmax) | |
|---|---|---|
| | Preliminary heating | No preliminary heating |
| Sample 7C | 2.60 | 1.38 |
| Sample 8C | 2.85 | 1.62 |

It is evident from the results shown in Table 7 that the samples 7C and 8C give high color density when laser exposure is carried out with preliminary heating at 100° C.

Effects of the Invention

Since the image recording medium of the present invention has high heat sensitivity, images can be recorded by such a low output laser that abrasion is not generated, even when a laser-aided heat mode image recording method is used. Particularly, it is possible to carry out image recording corresponding to 360 nm to 420 nm essential for a mask film for plate making use, and it does not require a special image receiving sheet. In addition, it is excellent in storage stability.

What is claimed is:

1. An image recording medium comprising an ultraviolet absorber precursor represented by formula (1-A) and an acid which is a polymer:

(1-A)

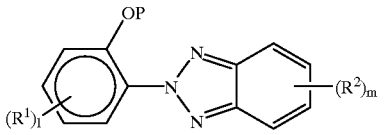

wherein P represents a protecting group for a hydroxyl group which is capable of being deblocked by heating to 250° C. or less in the presence of an acid; $R^1$ and $R^2$, which may be the same or different, each represents a substitutable group; 1 and m each represents an integer of 0 to 4; and when 1 or m is 2 or more, a plurality of groups represented by $R^1$ or $R^2$, which may be the same or different, may combine together to form a ring.

2. The image recording medium according to claim 1, wherein P in formula (1-A) is a secondary or tertiary alkoxycarbonyl group having a hydrogen atom at the β-position.

3. An image recording medium comprising a compound having an alkoxycarbonyl group P represented by formula (1-B) which is removed from the compound upon the action of heat or an acid, wherein the compound causes a change in the absorption region of 360 to 900 nm upon the bond cleavage of the alkoxycarbonyl group P or upon a following reaction to the bond cleavage of the alkoxycarbonyl group P:

(1-B)

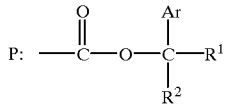

wherein, in formula (1-B) Ar represents an aryl group and $R^1$ and $R^2$ each represents a substitutable group; and wherein said compound has a structure which can form a hydrogen bond within the molecule upon the cleavage of the alkoxycarbonyl group P represented by formula (1-B).

4. The image recording medium according to claim 3, wherein the compound is represented by formula (2-B):

$$P—X—Y^1—Y^2—Y^3—Z \quad (2\text{-}B)$$

wherein, in formula (2-B), P has the same meaning as in formula (1-B); X and Z each represents an oxygen atom or a nitrogen atom; when X or Z represents an nitrogen atom, the nitrogen atom may have a hydrogen atom or a substituent group if necessary; when Z represents an oxygen atom, the oxygen atom may have a hydrogen atom or a substituent group if necessary; $Y^1$, $Y^2$ and $Y^3$ each represents a nitrogen atom or a carbon atom, which may have a hydrogen atom or a substituent group if necessary; X, $Y^1$, $Y^2$, $Y^3$ and Z may combine to each other to form a ring; and the bonds of X—$Y^1$, $Y^1$—$Y^2$, $Y^2$—$Y^3$ and $Y^3$—Z each may form a double bond.

5. The image recording medium according to claim 3, which further comprises an acid.

6. The image recording medium according to claim 5, wherein said acid is a polymer.

7. The image recording medium according to claim 5, wherein the compound is separated from the acid by encapsulating the compound in a microcapsule.

8. The image recording medium according to claim 5, wherein the compound and the acid are each applied onto different layers adjacent to each other.

9. A method for recording an image comprising subjecting the image recording medium according to claim 3 to scanning exposure with a laser beam.

10. A method for recording an image comprising preheating the thermal recording medium according to claim 7 over the entire surface thereof at 120° C. or less, and subjecting it to scanning exposure with a laser beam.

11. A method for recording an image comprising preheating the thermal recording medium according to claim 8 over the entire surface thereof at 120° C. or less, and subjecting it to scanning exposure with a laser beam.

12. An image recording medium comprising an ultraviolet absorber precursor represented by formula (1-A) and an acid:

(1-A)

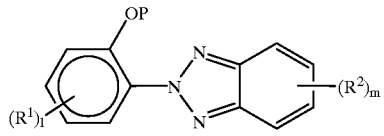

wherein P represents a protecting group for a hydroxyl group which is capable of being deblocked by heating to 250° C. or less in the presence of an acid; $R^1$ and $R^2$, which may be the same or different, each represents a substitutable group; 1 and m each represents an integer of 0 to 4; and when 1 or m is 2 or more, a plurality of groups represented by $R^1$ or $R^2$, which may be the same or different, may combine together to form a ring; and wherein the ultraviolet absorber precursor represented by formula (1-A) is separated from the acid by encapsulating the ultraviolet absorber precursor represented by formula (1-A) in a microcapsule or the ultraviolet absorber precursor represented by formula (1-A) and the acid are each applied onto different layers adjacent to each other.

13. A method for recording an image comprising preheating the thermal recording medium according to claim 12 over the entire surface thereof at 120° C. or less, and subjecting it to scanning exposure with a laser beam.

14. A method for recording an image comprising subjecting an image recording medium to scanning exposure with a laser beam, wherein said medium comprises an ultraviolet absorber precursor represented by formula (1-A) and an acid:

(1-A)

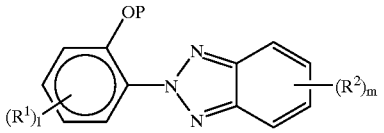

wherein P represents a protecting group for a hydroxyl group which is capable of being deblocked by heating to 250° C. or less in the presence of an acid; $R^1$ and $R^2$, which may be the same or different, each represents a substitutable group; 1 and m each represents an integer of 0 to 4; and when 1 or m is 2 or more, a plurality of groups represented by $R^1$ or $R^2$, which may be the same or different, may combine together to form a ring.

15. The image recording medium according to claim 1 wherein the protecting group is selected from the group consisting of an acyl group, a cyclopropylmethyl group, a primary alkoxycarbonyl group, a secondary alkoxycarbonyl group having a hydrogen atom at the β-position, a tertiary alkoxycarbonyl group having a hydrogen atom at the β-position, a silyl group, a secondary alkyl group having a hydrogen atom at the β-position and a tertiary alkyl group having a hydrogen atom at the β-position.

16. The image recording medium according to claim 12 wherein the protecting group is selected from the group consisting of an acyl group, a cyclopropylmethyl group, a primary alkoxycarbonyl group, a secondary alkoxycarbonyl group having a hydrogen atom at the β-position, a tertiary alkoxycarbonyl group having a hydrogen atom at the β-position, a silyl group, a secondary alkyl group having a hydrogen atom at the β-position and a tertiary alkyl group having a hydrogen atom at the β-position.

17. The method according to claim 14 wherein the protecting group in the image recording medium is selected from the group consisting of an acyl group, a cyclopropylmethyl group, a primary alkoxycarbonyl group, a secondary alkoxycarbonyl group having a hydrogen atom at the β-position, a tertiary alkoxycarbonyl group having a hydrogen atom at the β-position, a silyl group, a secondary alkyl group having a hydrogen atom at the β-position and a tertiary alkyl group having a hydrogen atom at the β-position.

18. The image recording medium according to claim 3 wherein Ar is selected from the group consisting of phenyl, naphthyl, furanyl, thienyl and pyridyl.

19. The image recording medium according to claim 18 wherein Ar has a substituent group at the substitutable position selected from the group consisting of a halogen atom, a nitro group, a cyano group, an alkyl group, an aryl group, an alkenyl group, an alkynyl group, an aralkyl group, a hetero ring residue, $—N(R^3)_2$, $—NHCO\ R^3$, $—NHCOOR^3$, $—CONHR^3$, $—COOR^3$, $OR^3$ and $—SR^3$, wherein $R^3$ is selected from the group consisting of a hydrogen atom, an alkyl group, an aryl group, an alkenyl group, an alkynyl group, an aralkyl group and a hetero ring residue.

20. The image recording medium according to claim 1 wherein the protecting group is eliminated within the temperature range of 80° C. to 150° C. under acidic conditions.

* * * * *